US007999833B2

(12) United States Patent
Richards

(10) Patent No.: US 7,999,833 B2
(45) Date of Patent: Aug. 16, 2011

(54) DEINTERLEAVING TRANSPOSE CIRCUITS IN DIGITAL DISPLAY SYSTEMS

(75) Inventor: Peter W. Richards, Menlo Park, CA (US)

(73) Assignee: Texas Instruments Incorporated, Dallas, TX (US)

( * ) Notice: Subject to any disclaimer, the term of this patent is extended or adjusted under 35 U.S.C. 154(b) by 853 days.

(21) Appl. No.: 11/963,476

(22) Filed: Dec. 21, 2007

(65) Prior Publication Data

US 2008/0094324 A1 Apr. 24, 2008

Related U.S. Application Data

(62) Division of application No. 10/648,689, filed on Aug. 25, 2003, now Pat. No. 7,315,294.

(51) Int. Cl.
*G09G 5/10* (2006.01)
*G09G 3/34* (2006.01)

(52) U.S. Cl. ..... 345/691; 345/84

(58) Field of Classification Search ..... 345/48, 345/50, 51, 55, 84, 87–93, 103, 108, 690, 345/693; 359/242, 245, 290, 291, 295, 298
See application file for complete search history.

(56) References Cited

U.S. PATENT DOCUMENTS 4,998,167 A 3/1991 Jaqua
5,068,904 A 11/1991 Yamazaki
5,079,544 A 1/1992 DeMond et al.
5,111,192 A 5/1992 Kadakia
5,132,928 A 7/1992 Hayashikoshi et al.
5,227,882 A 7/1993 Kato
5,255,100 A 10/1993 Urbanus
5,278,652 A 1/1994 Urbanus et al.
5,361,339 A 11/1994 Kadakia et al.
5,373,323 A 12/1994 Kwon
5,548,301 A 8/1996 Kornher et al.
5,663,749 A 9/1997 Farris et al.
5,862,095 A * 1/1999 Takahashi et al. ..... 365/222
6,172,797 B1 * 1/2001 Huibers ..... 359/291
6,201,521 B1 3/2001 Doherty
6,480,433 B2 11/2002 Huffman
6,714,476 B2 * 3/2004 Hsu et al. ..... 365/230.03

(Continued)

OTHER PUBLICATIONS

Klompenhouwer et al., Optically Reducing Motion Artifacts in Plasma Displays, SID 00, Digest, pp. 388-391.

*Primary Examiner* — Kevin M Nguyen
(74) *Attorney, Agent, or Firm* — Charles A. Brill; Wade James Brady, III; Frederick J. Telecky, Jr.

(57) ABSTRACT

The present invention provides a method and apparatus of converting a stream of pixel data in space and time into a stream of bitplane data. In particular, the present invention converts the pixel data stream according to a predetermined output format. The apparatus of the present invention receives the pixel data in a "real-time" fashion, and dynamically performs predefined permutations so as to accomplish the predefined transpose operation. Alternatively, the pixel data are stored in a storage medium, and the apparatus of the present invention retrieves the pixel data and performs the predefined permutation to accomplish the predefined transpose operation. The methods and apparatus disclosed herein are especially useful for processing a high-speed stream of digital data in a flow-through manner and suitable for implementation in a hardware video pipeline. The control signal fanout and gate count of this invention are reduced compared to currently available similar techniques for converting pixel data into bitplane data.

32 Claims, 10 Drawing Sheets

U.S. PATENT DOCUMENTS 6,774,916 B2 8/2004 Pettitt et al.
6,963,335 B2 * 11/2005 Tanaka et al. ..... 345/204
7,315,294 B2 1/2008 Richards
2002/0138688 A1 9/2002 Hsu et al.
2002/0149546 A1 10/2002 Ben-Chorin et al.
2003/0227677 A1 12/2003 Doherty et al.

* cited by examiner

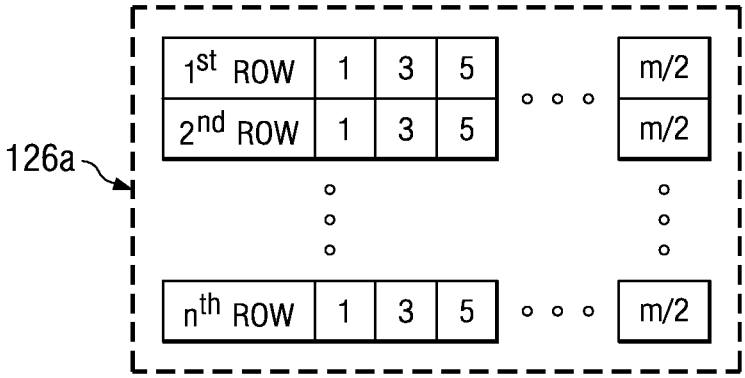
FIG. 7b
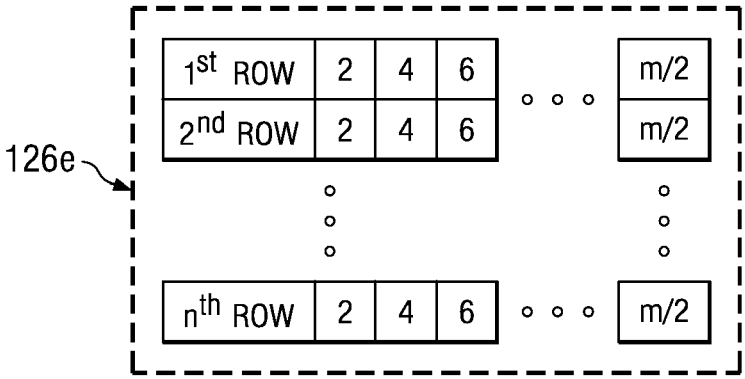
FIG. 7c
$$\begin{matrix} a_1^1 & a_2^1 & a_3^1 & a_4^1 & a_5^1 & a_6^1 & a_7^1 & a_8^1 \\ a_1^2 & a_2^2 & a_3^2 & a_4^2 & a_5^2 & a_6^2 & a_7^2 & a_8^2 \\ a_1^3 & a_2^3 & a_3^3 & a_4^3 & a_5^3 & a_6^3 & a_7^3 & a_8^3 \\ a_1^4 & a_2^4 & a_3^4 & a_4^4 & a_5^4 & a_6^4 & a_7^4 & a_8^4 \end{matrix} \Longrightarrow \begin{matrix} a_1^1 & a_2^1 & a_1^2 & a_2^2 & a_1^3 & a_2^3 & a_1^4 & a_2^4 \\ a_3^1 & a_4^1 & a_3^2 & a_4^2 & a_3^3 & a_4^3 & a_3^4 & a_4^4 \\ a_5^1 & a_6^1 & a_5^2 & a_6^2 & a_5^3 & a_6^3 & a_5^4 & a_6^4 \\ a_7^1 & a_8^1 & a_7^2 & a_8^2 & a_7^3 & a_8^3 & a_7^4 & a_8^4 \end{matrix}$$
FIG. 8a

DEINTERLEAVING TRANSPOSE CIRCUITS IN DIGITAL DISPLAY SYSTEMS

This application is a divisional of application Ser. No. 10/648,689, filed Aug. 25, 2003.

TECHNICAL FIELD OF THE INVENTION

The present invention is related generally to the art of digital display systems using spatial light modulators such as micromirror arrays or ferroelectric LCD arrays, and more particularly, to methods and apparatus for converting a stream of image data from a pixel-by-pixel format into bitplane-by-bitplane format.

BACKGROUND OF THE INVENTION

In current digital display systems using micromirror arrays or other similar spatial light modulators such as ferroelectric LCDs, each pixel of the array is individually addressable and switchable between an ON state and an OFF state. In the ON state, the micromirror reflects incident light so as to generate a "bright" pixel on a display target. In the OFF state, the micromirror reflects the incident light so as to generate a "dark" pixel on the display target. Grayscale images can be created by turning the micromirror on and off at a rate faster than the human eye can perceive, such that the pixel appears to have an intermediate intensity proportional to the fraction of the time when the micromirror is on. This method is generally referred to as pulse-width-modulation (PWM). Full-color images may be created by using the PWM method on separate SLMs for each primary color, or by a single SLM using a field-sequential color method.

For addressing and turning the micromirror on or off, each micromirror may be associated with a memory cell circuit that stores a bit of data that determines the ON or OFF state of the micromirror. In order to achieve various levels of perceived light intensity by human eyes using PWM, each pixel of a grayscale image is represented by a plurality of data bits. Each data bit is assigned significance. Each time the micromirror is addressed, the value of the data bit determines whether the addressed micromirror is on or off. The bit significance determines the duration of the micromirror's on or off period. The bits of the same significance from all pixels of the image are called a bitplane. If the elapsed time the micromirrors are left in the state corresponding to each bitplane is proportional to the relative bitplane significance, the micromirrors produce the desired grayscale image.

In practice, the memory cells associated with the micromirror array are loaded with a bitplane at each designated addressing time. During a frame period, a number of bitplanes are loaded into the memory cells for producing the grayscale image; wherein the number of bitplanes equals the predetermined number of data bits representing the image pixel.

The bitplane-by-bitplane formatted image data (hereafter, bitplane data), however, are not immediately available from peripheral image sources, such as a video camera, DVD/VCD player, TV/HDTV tuner, or PC video card, because the outputs (thus the input for the memory cells) of the image sources are usually either pixel-by-pixel formatted data (hereafter, pixel data), in which all bits of a single pixel are presented simultaneously, or standard analog signals that are digitized and transformed into pixel data. Pixel data is typically provided as a set of parallel signals, each of which carries a bit of different significance. All bits of a particular pixel are presented simultaneously across the set of signals. Successive pixels in the image are presented sequentially in time, typically synchronized with a pixel clock which is either provided by the image source or derived from other timing signals provided by the image source (such as horizontal- and vertical-sync signals). The pixel-by-pixel data format for the stream of video data is natural for non-PWM display technologies such as CRTs or analog LCDs, and has become the standard format for video data due to the historical dominance of these technologies. In order for PWM-based digital displays to interface with pixel-by-pixel formatted image sources, it is necessary to reformat the incoming video data (e.g. the pixel data) such that the bitplanes of the image can be stored and retrieved efficiently.

Therefore, methods and apparatus are desired for transforming a stream of pixel data into bitplane data.

SUMMARY OF THE INVENTION

In view of the foregoing, the present invention provides a method and apparatus of converting a stream of pixel data in space and time into a stream of bitplane data. In particular, the present invention converts the pixel data stream according to a predetermined output format. The apparatus of the present invention receives the pixel data in a "real-time" fashion, and dynamically performs predefined permutations so as to accomplish the predefined transpose operation. In another embodiment of the invention, the pixel data are stored in a storage medium, and the apparatus of the present invention retrieves the pixel data and performs the predefined permutation to accomplish the predefined transpose operation. The methods and apparatus disclosed herein are especially useful for processing a high-speed stream of digital data in a flow-through manner and suitable for implementation in a hardware video pipeline. The control signal fanout and gate count of this invention are reduced compared to currently available similar techniques for converting pixel data into bitplane data.

In an embodiment of the invention, a method used in a spatial light modulator that comprises an array of pixels, wherein the pixels of each row of the array are divided into a plurality of subgroups, for producing an image is disclosed. The method comprises: receiving a set of pixel data streams, wherein the pixel data of each stream represent a set of states of a pixel of the spatial light modulator during different time intervals; transforming the received pixel data streams into a set of bitplane data streams, wherein the bitplane data of each stream represent the states of a plurality of pixels during one time interval, such that the bitplane data streams representing the pixels of the same subgroup are parallel and adjacent; and updating the states of the pixels using the transformed bitplane data.

In another embodiment of the invention, a system is disclosed. The system comprises: a memory cell array, wherein a row of said array comprises a first and second subset, each subset having one or more memory cells; a first wordline and a second wordline, wherein the first wordline is connected to the first subset memory cells, and the second wordline is connected to the second subset memory cells; a first set of data to be loaded into the first subset of memory cells that are activated through the first wordline, wherein the first set of data is consecutively stored in a first region of a storage medium; and a second set of data to be loaded into the second subset of memory cells that are activated through the second wordline, wherein the second set of data is consecutively stored in a second region of the storage medium.

In yet another embodiment of the invention, a method for writing a memory cell array, wherein a row of the memory cell array comprises a first and second subset of memory cells, each subset having one or more memory cells is disclosed. The method comprises: connecting the memory cells of the first subset to a first wordline, and the memory cells of the second subset to a second wordline; storing a first and second set of data such that the data of the first set are stored consecutively in a first region and the data of the second set are consecutively stored in a second region separate from the first region; activating the memory cells of the first subset through the first wordline; and loading the first set of data into the activated first subset of memory cells.

In yet another embodiment of the invention, a system is provided. The system comprises: a data converter having a plurality of inputs and outputs, wherein the data converter transposes a first data matrix into a second data matrix; a first storage medium that is connected to the outputs of the data converter and consecutively stores a first portion of the second data matrix; a second storage medium that is connected to the outputs of the data converter and consecutively stores a second portion of the second data matrix; and wherein the first portion and the second portion are interleaved in the second data matrix.

In yet another embodiment of the invention, a system is provided. The system comprises: a data processing unit that receives a first set of data and outputs a second set of data other than the first set of data; a first storage medium that is connected to the outputs of the data processing unit and consecutively stores a first portion of the second set of data; a second storage medium that is connected to the outputs of the data converter and consecutively stores a second portion of the second set of data; an array of memory cells, wherein a row of the array comprises a first and second subset, each subset having one or more memory cells; a first wordline and second wordline, wherein the first wordline is connected to the first subset memory cells and the second wordline is connected to the second subset memory cells; and wherein the data stored in the first storage medium is to be loaded into the memory cells connected to the first wordline, and the data stored in the first storage medium is to be loaded into the memory cells connected to the first wordline.

In yet another embodiment of the invention, a computer-readable medium having computer executable instructions for performing a method of writing a memory cell array is disclosed, wherein a row of the memory cell array comprises a first and second subset of memory cells, each subset having one or more memory cells, and wherein the memory cells of the first subset are connected to a first wordline, and the memory cells of the second subset are connected to a second wordline, and wherein the method comprises: storing a first and second set of data such that the data of the first set are stored consecutively in a first region and the data of the second set are consecutively stored in a second region separate from the first region; activating the memory cells of the first subset through the first wordline; and loading the first set of data into the activated first subset of memory cells.

BRIEF DESCRIPTION OF DRAWINGS

While the appended claims set forth the features of the present invention with particularity, the invention, together with its objects and advantages, may be best understood from the following detailed description taken in conjunction with the accompanying drawings of which:

FIG. 7*b* is a diagram illustrating an exemplary data structure of bitplane data structure for odd numbered pixels;

FIG. 7*c* is a diagram illustrating an exemplary data structure of bitplane data structure for even numbered pixels;

FIG. 8*a* illustrates a data conversion from a 4×4 matrix of pixel data into a 4×4 bitplane data matrix, wherein the bitplane data for the odd numbered pixels and the bitplane data for the even numbered pixels are separated;

DETAILED DESCRIPTION OF THE EMBODIMENTS

Embodiments of the present invention can be implemented in a variety of ways and display systems. In the following, embodiments of the present invention will be discussed in a display system that employs a micromirror array and a pulse-width-modulation technique, wherein individual micromirrors of the micromirror array are controlled by memory cells of a memory cell array. It will be understood by those skilled in the art that the embodiments of the present invention are applicable to any grayscale or color pulse-width-modulation methods or apparatus, such as those described in U.S. Pat. No. 6,388,661, and U.S. patent application Ser. No. 10/340,162, filed Jan. 10, 2003, both to Richards, the subject matter of each being incorporated herein by reference. Each memory cell of the memory cell array can be a standard 1T1C (one transistor and one capacitor) circuit. Alternatively, each memory cell can be a "charge-pump-memory cell" as set forth in U.S. patent application Ser. No. 10/340,162 filed Jan. 10, 2003 to Richards, the subject matter being incorporated herein by reference. A charge-pump-memory-cell comprises a transistor having a source, a gate, and a drain; a storage capacitor having a first plate and a second plate; and wherein the source of said transistor is connected to a bitline, the gate of said transistor is connected to a wordline, and wherein the drain of the transistor is connected to the first plate of said storage capacitor forming a storage node, and wherein the second plate of said storage capacitor is connected to a pump signal. It will be apparent to one of ordinary skills in the art that the following discussion applies generally to other types of memory cells, such as DRAM, SRAM or latch. The wordlines for each row of the memory array can be of any suitable number equal to or larger than one, such as a memory cell array having multiple wordlines as set forth in U.S. patent application Ser. No. "A Method and Apparatus for Selectively Updating Memory Cell Arrays" filed Apr. 2, 2003 to Richards, the subject matter being incorporated herein by reference. For clarity and demonstration purposes only, the embodiments of the present invention will be illustrated using binary-weighted PWM waveforms. It is clear that other PWM waveforms (e.g. other bit-depths and/or non binary weightings) may also be applied. Furthermore, although not limited thereto, the present invention is particularly useful for operating micromirrors such as those described in U.S. Pat. No. 5,835,256, the contents of which are hereby incorporated by reference.

Figure 1:
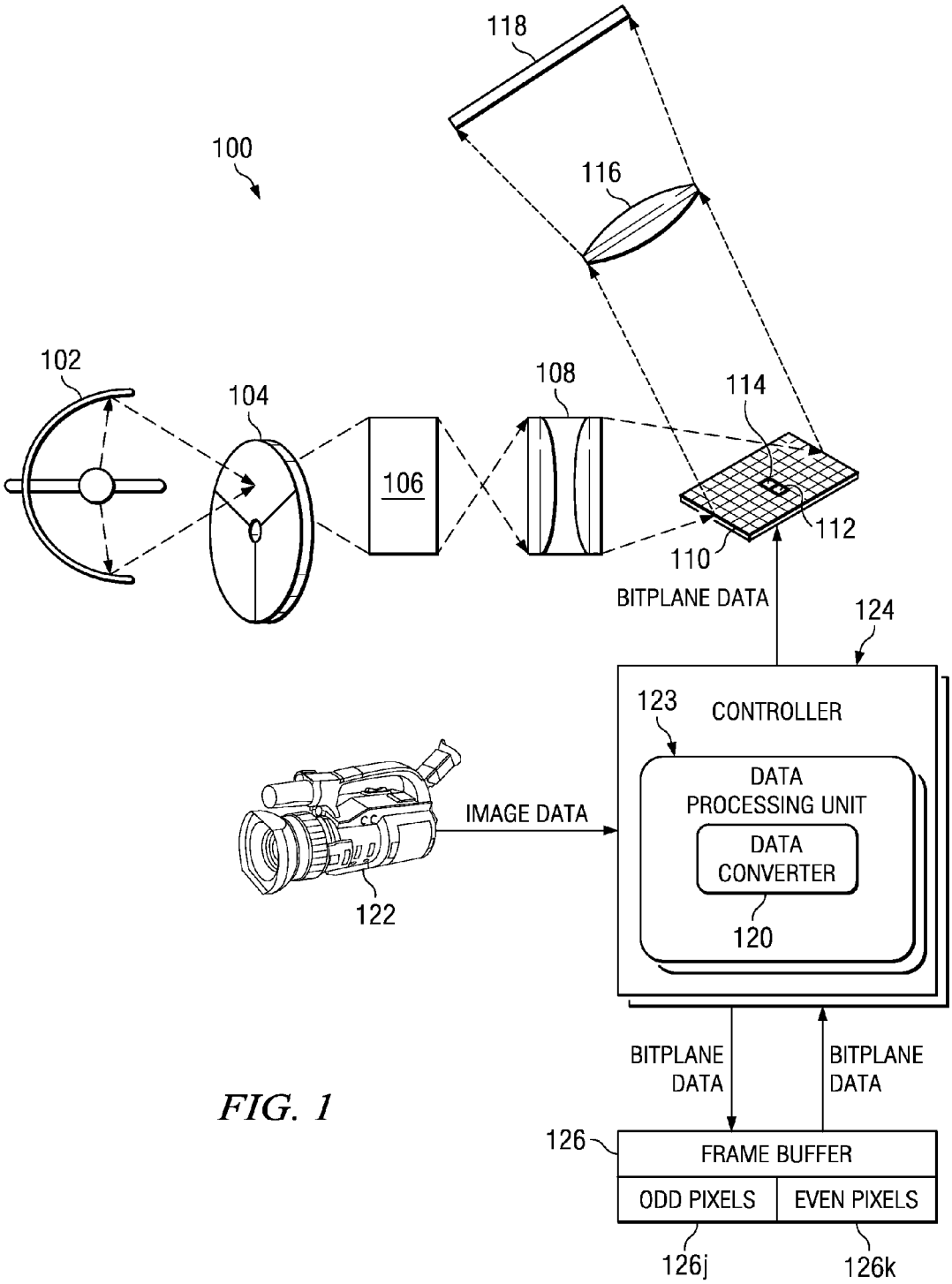
FIG. 1 illustrate an exemplary display system using a spatial light modulator having an array of micromirrors.

Turning to the drawings, FIG. 1 illustrates a simplified display system using a spatial light modulator having a micromirror array, in which embodiments of the present invention can be implemented. In its very basic configuration, display system 100 comprises light source 102, optical devices (e.g. light pipe 106, condensing lens 108 and projection lens 116), display target 118, spatial light modulator 110 that further comprises an array of micromirrors (e.g. micromirrors 112 and 114), and controller 124 (e.g. as disclosed in U.S. Pat. No. 6,388,661 issued May 14, 2002 incorporated herein by reference). The data controller comprises data processing unit 123 that further comprises data converter 120. Color filter 104 may be provided for creating color images.

Light source 102 (e.g. an arc lamp) emits light through color filter 104, light integrator/pipe 106 and condensing lens 108 and onto spatial light modulator 110. Each pixel (e.g. pixel 112 or 114) of spatial light modulator 110 is associated with a pixel of an image or a video frame. The pixel of the spatial light modulator operates in binary states—an ON state and an OFF state. In the ON state, the pixel reflects incident light from the light source into projection lens 116 so as to generate a "bright" pixel on the display target. In the OFF state, the pixel reflects the incident light away from projection optics 116—resulting a "dark" pixel on the display target. The states of the pixels of the spatial light modulator is controlled by a memory cell array, such as the memory cell arrays illustrated in FIGS. 3*a* and 3*b*, which will be discussed afterwards.

Figure 2:
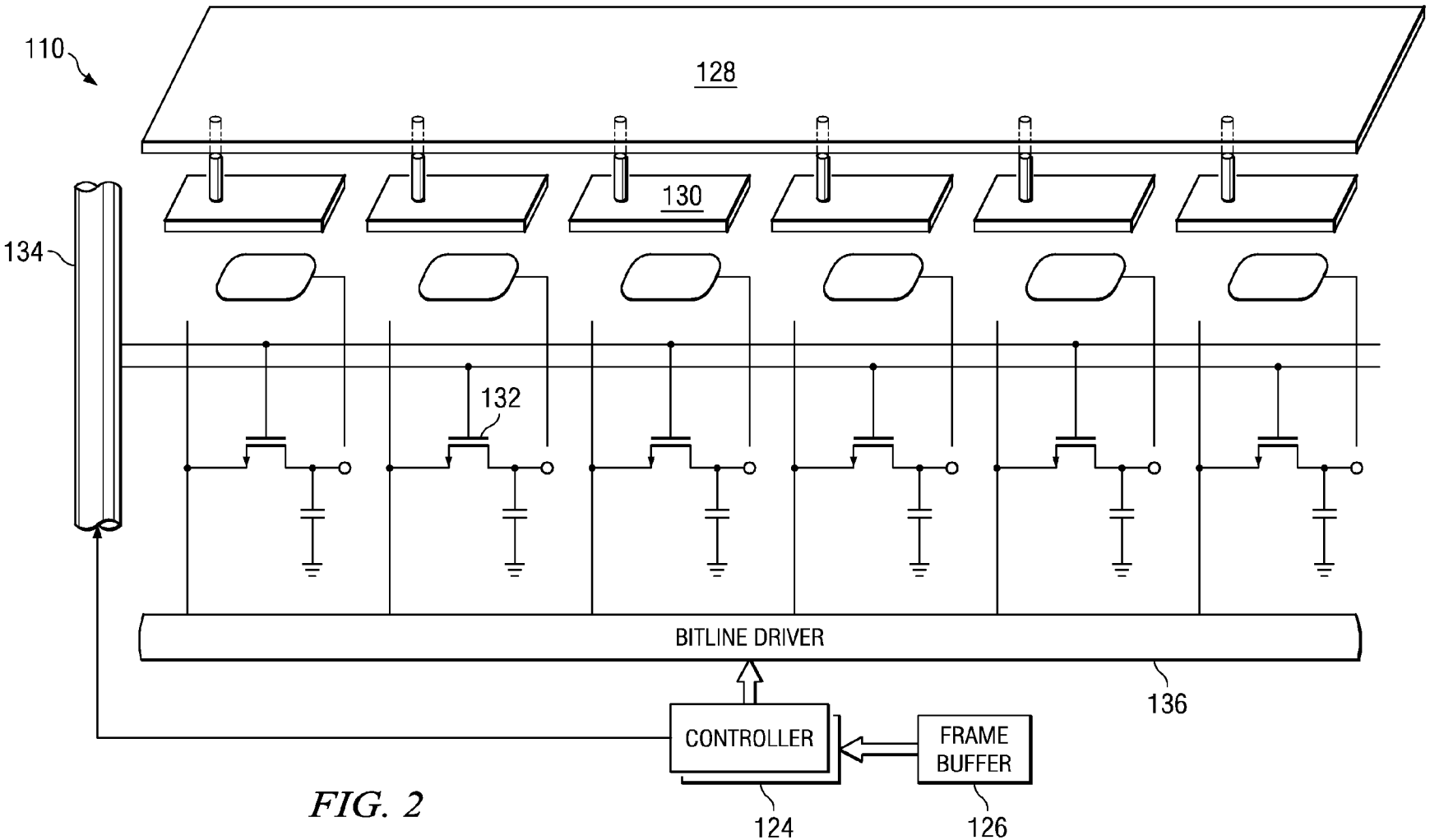
FIG. 2 is a diagram schematically illustrating a cross-sectional view of a portion of a row of the micromirror array and a controller connected to the micromirror array for controlling the states of the micromirrors of the array.

A micromirror typically comprises a movable mirror plate that reflects light and a memory cell disposed proximate to the mirror plate, which is better illustrated in FIG. 2. Referring to FIG. 2, a cross-sectional view of a portion of a row of the micromirror array of spatial light modulator 110 in FIG. 1 is illustrated therein. Each mirror plate is movable and associated with an electrode and memory cell. For example, mirror plate 130 is associated with memory cell 132 and an electrode that is connected to a voltage node of the memory cell. In other alternative implementations, each memory cell can be associated with a plurality of mirror plates. Specifically, each memory cell is connected to a plurality of pixels (e.g. mirror plates) of a spatial light modulator for controlling the state of those pixels of the spatial light modulator. An electrostatic field is established between the mirror plate and the electrode. In response to the electrostatic field, the mirror plate is rotated to the ON state or the OFF state. The data bit stored in the memory cell (the voltage node of the memory cell) determines the electrostatic field, thus determines whether the mirror plate is on or off.

The memory cells of the row of the memory cell array are connected to dual wordlines for activating the memory cells of the row, which will be discussed in detail with reference to FIG. 3*a* and FIG. 3*b* afterwards. Each memory cell is connected to a bitline, and the bitlines of the memory cells are connected to bitline driver 136. In operation, controller 124 initiates an activation of selected memory cells by sending an activation signal to decoder 134. The decoder activates the selected memory cells by activating the wordline connected to the selected memory cells. Meanwhile, the controller retrieves a plurality of bitplane data to be written to the selected memory cells from frame buffer 126 and passes the retrieved bitplane data to the bitline driver, which then delivers the bitplane data to the selected memory cells that are activated.

The memory cells of the row are connected to a plurality of wordlines (, though only two wordlines are presented in the figure), such as the multiple wordline in memory cell array as disclosed in U.S. patent application Ser. No. "Methods and Apparatus for Selectively Updating Memory Cell Arrays" filed on Apr. 2, 2003 to Richards, the subject matter being incorporated herein by reference. The provision of the multiple wordline enables the memory cells of the row to be selectively updated. The timing of update events to neighboring memory cells of the row can thus be decorrelated. This configuration is especially useful in digital display systems that use a pulse-width-modulation technique. Artifacts, such as dynamic-false-contouring artifacts can be reduced or eliminated. Therefore, the perceived quality of the images or video frames is improved.

In order to selectively update memory cells of a row of a memory cell array, the memory cells of the row are divided into subgroups according to a predefined criterion. For example, a criterion directs that neighboring memory cells in a row are grouped into separate subgroups. A portion of a memory cell array complying with such rule is illustrated in FIG. 3*a*. Referring to FIG. 3*a*, for example, memory cell row 138 of the memory cell array comprises memory cells 138*a*, 138*b*, 138*c*, 138*d*, 138*e*, 138*f* and 138*g*. These memory cells are divided into subgroups according to a predefined criterion, which directs that adjacent memory cells are in different subgroups. In this figure, the memory cells are divided into two subgroups. One subgroup comprises odd numbered memory cells, such as 138*a*, 138*c*, 138*e* and 138*g*. Another subgroup comprises even numbered memory cells, such as 138*b*, 138*d* and 138*f*. These memory cells are connected to wordlines 140*a* and 140*b* such that memory cells of the same subgroup are connected to the same wordline and the memory cells are connected to separate wordlines. Specifically, the odd numbered memory cells 138*a*, 138*c*, 138*e* and 138*g* are connected to wordline 140*a*. And even numbered memory cells 138*b*, 138*d* and 138*f* are connected to wordline 140*b*.

The memory cells of a row of the memory cell array may be divided according to other criteria. For example, another criterion directs that the positions of the memory cells in a row in different subgroups are interleaved. A portion of a memory cell array complying with this criterion is illustrated in FIG. 3*b*. Referring to FIG. 3*b*, for example, memory cell row 138 of the memory cell array comprises memory cells 138*a*, 138*b*, 138*c*, 138*d*, 138*e*, 138*f* and 138*g*. These memory cells are divided into subgroups according to the predefined criterion. Specifically, one memory cell subgroup comprises memory cells 138*a*, 138*b*, 138*e* and 138*f*. Another subgroup comprises memory cells 138*c*, 138*d* and 138*g*. The positions of the memory cells in the two subgroups are interleaved. These memory cells are connected to wordlines 140*a* and 140*b* such that memory cells of the same subgroup are connected to the same wordline and the memory cells are connected to separate wordlines. Specifically, the memory cells 138*a*, 138*b*, 138*e* and 138*f* are connected to wordline 140*a*. And memory cells 138*c*, 138*d* and 138*g* are connected to wordline 140*b*.

Because the memory cells of a row of the memory cell array in different subgroups are connected to separate wordlines, the memory cells can be activated or updated independently by separate wordlines. Memory cells in different subgroups of the row can be activated asynchronously or synchronously as desired by scheduling the activation events of the wordlines. Moreover, memory cells in different rows of the memory cell array can be selectively updated asynchronously or synchronously as desired. For example, one can simultaneously update memory cells in a subgroup (e.g. even numbered memory cells) of a row and memory cells in another subgroup (e.g. odd numbered memory cells) of a different row. Of course, memory cells in different subgroups of different rows can be activated at different times.

In digital display system, the memory cell array is part of a spatial light modulator that comprises an array of pixels, each of which corresponds to a pixel of an image or a video frame and the modulation states of the pixels of the spatial light modulator are controlled by the memory cell array. Because the memory cells of the memory cell array are individually addressable and decorrelated by the provision of multiple wordlines, the pixels of the spatial light modulator are also individually controllable and decorrelated. As a consequence, artifacts, such as the dynamic-false-contouring artifacts are in displayed images or video frames are reduced or eliminated.

Figure 3A:
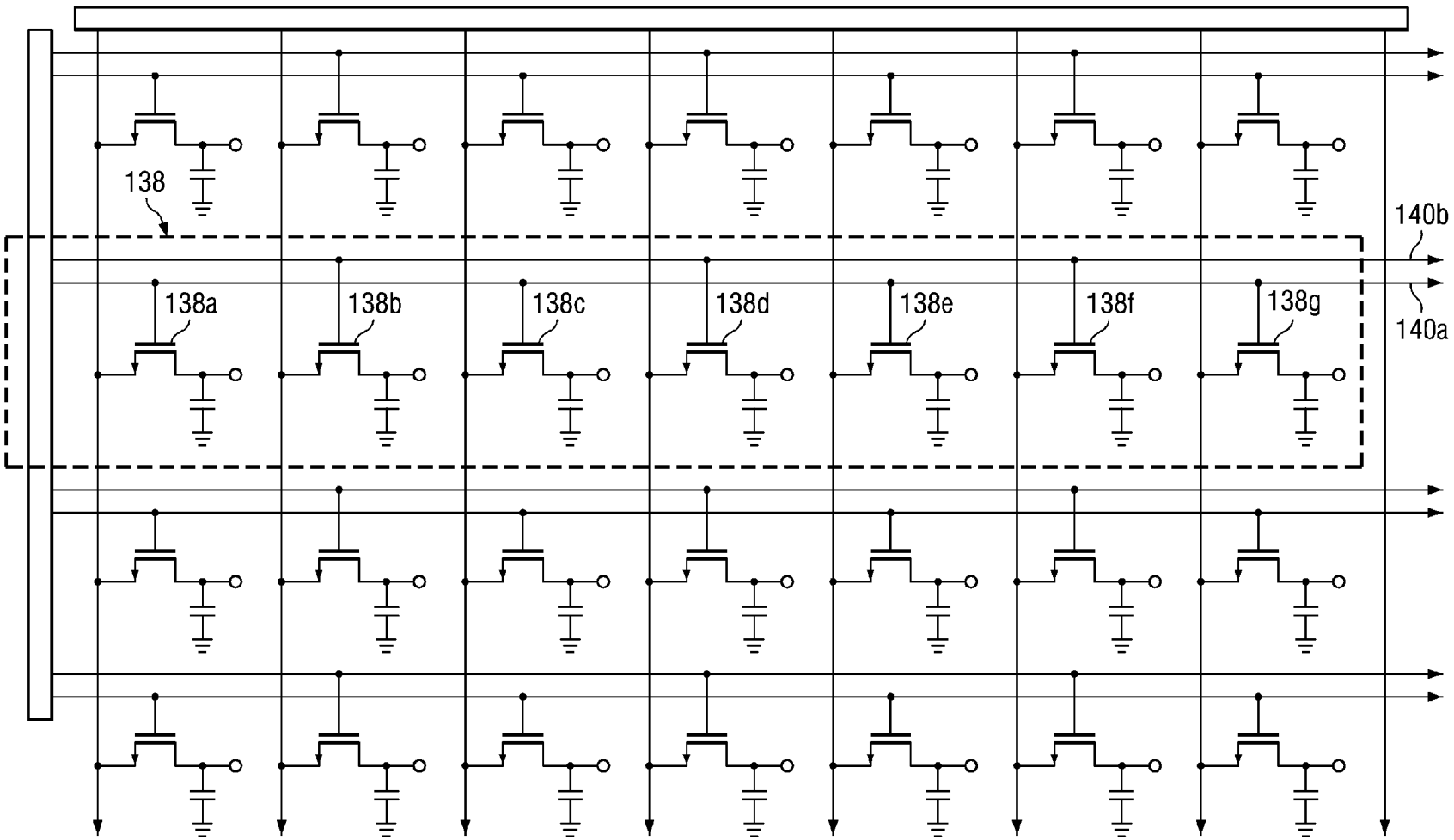
FIG. 3*a* illustrates an exemplary memory cell array used in the spatial light modulator of FIG. 1.
Figure 3B:
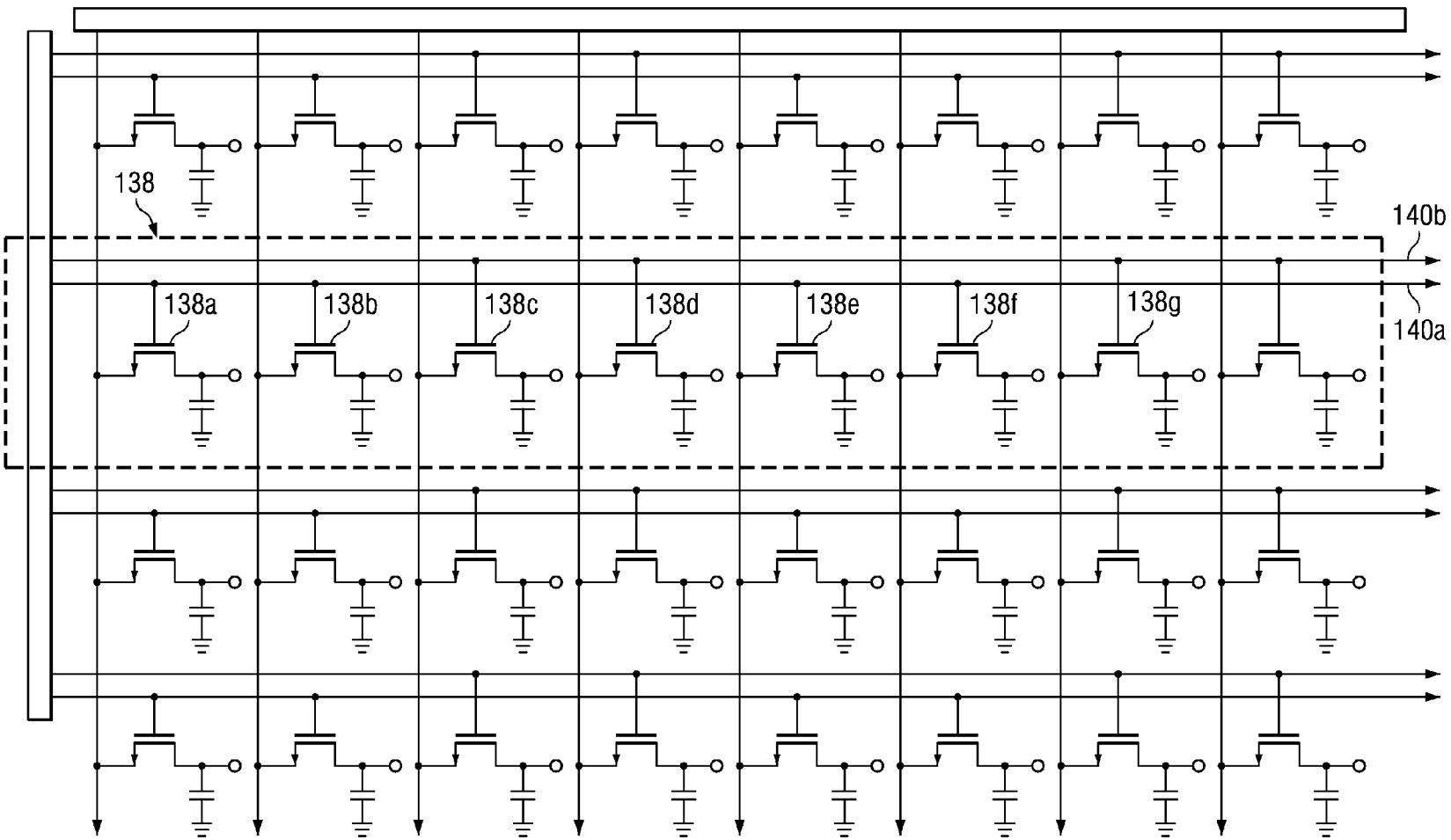
FIG. 3*b* illustrates another exemplary memory cell array used in the spatial light modulator of FIG. 1.

In FIGS. 2, 3*a* and 3*b*, the memory cells are illustrated as standard 1T1C memory cells. It should be understood than this is not an absolute requirement. Instead, other memory cells, such as a charge-pump-memory cell, DRAM or SRAM could also be used. Moreover, the memory cells of each row of the memory cell array could be provided with more than one wordline for addressing the memory cells. In particular, two wordlines could be provided for each row of memory cells of the memory cell array as set forth in U.S. patent application Ser. No. "Methods and Apparatus for Selectively Updating Memory Cell Arrays" filed on Apr. 2, 2003 to Richards, the subject matter being incorporated herein by reference.

In order to display grayscale or color images and/or video frames using the spatial light modulator having the memory cell arrays as shown in FIG. 3*a* and FIG. 3*b*, a pulse-width-modulation technique is employed, and the bitplane data of the pulse-width-modulation technique need to be provided properly. Provision of the proper bitplane data is achieved by controller 124 and frame buffer 126 as shown in FIG. 1.

Turning back to FIG. 1, controller 124 receives image data from peripheral image sources, such as video camera 122 and processes the received image data into pixel data as appropriate by data processing unit 123, which is a part of the controller. Alternatively, the data processing unit can be an independent functional unit from the controller. In this case, the data processing unit receives data from the image source and passes processed data onto the controller. Image source 122 may output image data with different formats, such as analog signals and/or digitized pixel data. If analog signals are received, the data processing unit samples the image signals and transforms the image signals into digital pixel data.

The pixel data are then received by data converter 120, which converts the pixel data into bitplane data that can be loaded into the memory cells of the memory cell array for controlling the pixels of the spatial light modulator to generate desired images or video frames, which will be discussed in detail afterwards with reference to FIG. 5 through FIG. 10.

The converted bitplane data are then stored in a storage medium, such as frame buffer 126, which comprises a plurality of separate regions, each region storing bitplane data for the pixels of one subgroup. For demonstration purposes and simplicity purposes only, the memory cells of a row of the memory cell array are connected to two wordlines, and the even numbered memory cells and the odd numbered memory cells are connected to one of the two wordlines, as shown in FIG. 2 and FIG. 3*a*. Accordingly, the frame buffer comprises one region for storing bitplane data for odd numbered memory cells and another region for storing the bitplane for the even numbered memory cells. In other alternatives in which the memory cells of a row of the memory cell array are divided into a plurality of subgroups according to a predefined criterion. And a plurality of wordlines are connected to the memory cells of the row such that the memory cells of the same subgroup are connected to the same wordline and memory cells of different subgroups are connected to separate wordlines. In these cases, the frame buffer comprises a number of regions, each of which stores bitplane data for the memory cells that are to be activated at the same time based on the subgroups.

In operation, the controller activates the selected memory cells (e.g. the odd numbered memory cells of each row) by the wordlines connected to the selected memory cells (e.g. the wordlines, each of which connects the odd numbered memory cells of each row) and retrieves the bitplane data for the selected memory cells from a region (e.g. the region storing the bitplane data for the odd numbered memory cells) of the frame buffer. The retrieved bitplane data are then delivered to the activated memory cells through the bitline driver and the bitlines connecting the activated memory cells. In order to update all memory cells of the spatial light modulator using the bitplane data of the same significance, the memory cells may be selected and updated using different wordlines according to the above procedures at different times until all memory cells are updated. In practice, each memory cell will be addressed and updated a number of times during a predefined time period, such as a frame interval. And the number of times equals the number of bitplanes designated for presenting the grayscales of the image.

Figure 4:
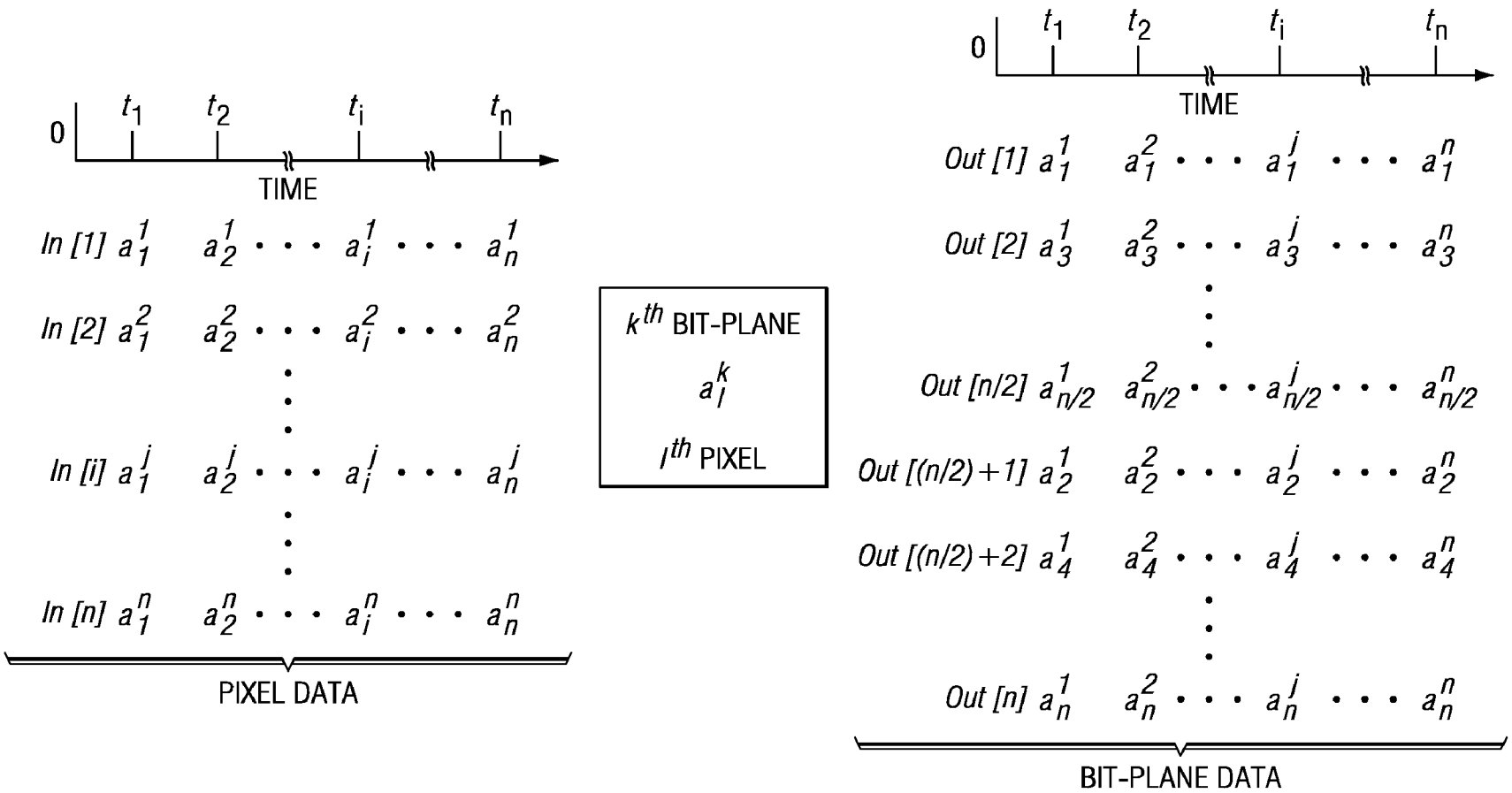
FIG. 4 presents exemplary set of pixel data streams and exemplary set of bitplane data streams.

Referring to FIG. 4, exemplary pixel data and exemplary bitplane data are illustrated therein. In this figure, symbol $a_l^k$ represents a binary data bit in a sense that that the data bit is either "1" or "0". "1" and "0" correspond to relative voltages of the memory cell. For example, "1" and "0" respectively correspond to a high voltage and a low voltage of the memory cell. Alternatively, "1" and "0" respectively correspond to the low voltage and the high voltage of the memory cell. The subscription l identifies the pixel of the desired image. The value of $a_l^k$ determines the voltage of the memory cell, thus the on or off state of the micromirror. The superscript k labels the bit number (or the significance) of the pixel based on the pulse-width-modulation. For example, k could be a number from 1 to n (e.g. n=8) when n data bits (e.g. 8 bits) are used to represent different grays levels (e.g. 256 levels for 8 bits) of the pixel using the pulse-width-modulation technique. The value of k determines the time of the voltage maintained by the memory cell.

The pixel data is ordered in time by the positions of pixels of the desired image. In display systems without micromirrors, data bits of the same pixel are loaded at one time for producing the pixel of the image. For example, at time $t_1$, data bits in the first column ($a_I^1$, $a_I^2$ . . . $a_I^j$ . . . $a_I^n$) are loaded for producing the first pixel of the desired image. At another time $t_i$, data bits in the $i^{th}$ column ($a_i^1$, $a_i^2$ . . . $a_i^j$ . . . $a_i^n$) are loaded for producing the $i^{th}$ pixel of the desired image.

In contrast, the bit plate data is primarily ordered by bits of all pixels of the desired image. Data bits of the same significance for all pixels are generally referred to as a bitplane. In display systems using micromirrors, data bits of the same significance for the pixels of the desired image are loaded at one time for actuating the mirror plates. According to the invention, the bitplane data of the same significance for the memory cells of a subgroup of a row of the memory cell array are loaded into the memory cells that are activated by separate wordlines. In this regards, the bitplane data of the same significance for the memory cells that are activated by the same wordline are outputted consecutively. As a way of example, the bitplane data are to be loaded to the memory cells of the memory cells array of FIG. 3*a*, in which the odd numbered memory cells and the even numbered memory cells are connected to separate wordlines. Accordingly, the bitplane data in FIG. 4 are organized such that the bitplane data for the odd numbered memory cells are outputted consecutively. For example, at time $t_1$, bitplane data $a_1^1, a_3^1, a_5^1 \ldots a_{n-1}^1$, representing the $1^{st}$ bitplane of the odd numbered memory cells (e.g. 1, 3, 5 . . . n−1), are outputted consecutively by output lines Out[1], Out[2], Out[3] . . . . Out[n/2]. These output lines are arranged in parallel and consecutive. And the bitplane data $a_2^1, a_4^1, a_6^1 \ldots a_n^1$ for the even numbered memory cells (e.g. 2, 4, 6 . . . n) are outputted consecutively by output lines Out[(n/2)+1], Out[(n/2)+2], Out[(n/2)+3] . . . . Out[n]. At another time $t_j$, bitplane data $a_1^i, a_3^i, a_5^i \ldots a_{n/2}^i$, representing the $i^{th}$ bitplane of the odd numbered memory cells (e.g. 1, 3, 5 . . . n−1) are outputted consecutively by output lines Out[1], Out[2], Out[3] . . . . Out[n/2]. And the bitplane data $a_2^i, a_4^i, a_6^i \ldots a_n^i$ for the even numbered memory cells (e.g. 2, 4, 6 . . . n) are outputted consecutively by output lines Out[(n/2)+1], Out[n/2)+2], Out[n/2)+3] . . . . Out[n]. These output lines are arranged in parallel and consecutive.

By comparing the pixel data matrix and the bitplane data matrix, it can be seen that the bitplane data matrix is a transformation matrix of the pixel data matrix. By "data matrix m×n", it is meant that a block of data elements that are organized into n rows and m columns of data elements. The data elements in each row are disposed in time sequence—that is the data elements in a row are delivered at different time units. The data elements in each column are delivered at the same time.

The bitplane data as shown in FIG. 4 are organized in accordance to the configuration of the multiple wordlines in the memory cell array of FIG. 3*a*, in which the odd numbered memory cells and the even numbered memory cells are respectively connected to one of the two separate wordlines. In other alternatives, the memory cells of each row of the memory cell array may be connected to multiple wordlines according to different scheme, such as the memory cell array and the wordlines as shown in FIG. 3*b*. In this case, the bitplane data of the same significance are arranged according to the configuration of the wordlines in the memory cell array. For example, for writing the memory cell array in FIG. 3*b*, a bitplane is preferably arranged such that, at time $t_1$, bitplane data $\{a_1^1, a_2^1, a_5^1, a_6^1 \ldots a_i^1, a_{i+1}^1, a_{i+4}^1, a_{i+5}^1 \ldots\}$, representing the $1^{st}$ bitplane of the first subgroup of memory cells (e.g. 1, 2, 5, 6 . . . i, i+1, i+4, i+5 . . . ), are outputted consecutively by output lines Out[1], Out[2], Out[3] . . . . Out[n/2] these output lines are arranged in parallel and consecutive. And the bitplane data $\{a_3^1, a_4^1, a_7^1, a_8^1 \ldots a_{i+2}^1, a_{i+3}^1, a_{i+6}^1, a_{i+7}^1 \ldots\}$ for the second subgroup of memory cells (e.g. 3, 4, 7, 8 . . . i+2, i+3, i+6, i+8 . . . ) are outputted consecutively by output lines Out[(n/2)+1], Out[(n/2)+2], Out[(n/2)+3] . . . . Out[n]. At another time $t_j$, bitplane data $\{a_1^j, a_2^j, a_5^j, a_6^j \ldots a_i^j, a_{i+1}^j, a_{i+4}^j, a_{i+5}^j \ldots\}$, representing the $j^{th}$ bitplane of the first subgroup of memory cells (e.g. 1, 2, 5, 6 . . . i, i+1, i+4, i+5 . . . ), are outputted consecutively by output lines Out[1], Out[2], Out[3] . . . . Out[n/2] these output lines are arranged in parallel and consecutive. And the bitplane data $\{a_3^j, a_4^j, a_7^j, a_8^j \ldots a_{i+2}^j, a_{i+3}^j, a_{i+6}^j, a_{i+7}^j \ldots\}$ for the second subgroup of memory cells (e.g. 3, 4, 7, 8 . . . i+2, i+3, i+6, i+8 . . . ) are outputted consecutively by output lines Out[(n/2)+1], Out[(n/2)+2], Out[(n/2)+3] . . . . Out[n].

Figure 7A:
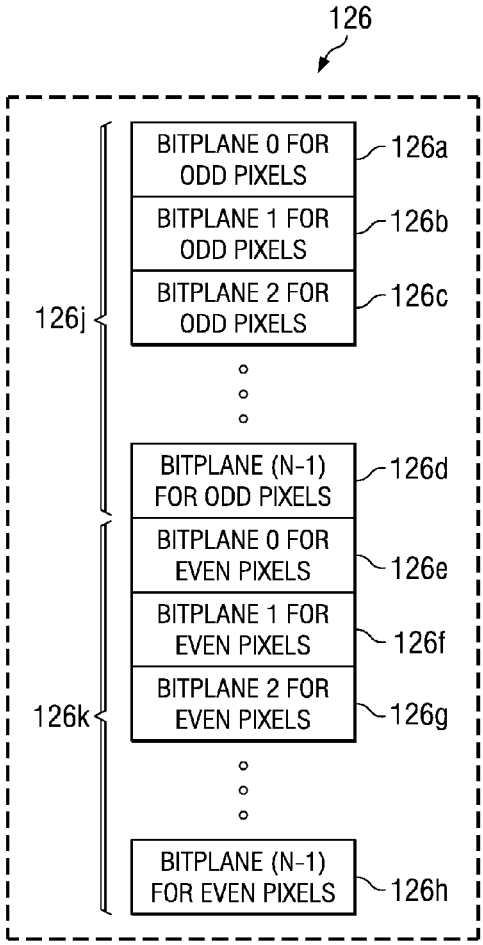
FIG. 7*a* is a block diagram illustrating an exemplary data structure of the frame buffer in FIG. 5.

The bitplane data are preferably stored in a storage medium, such as frame buffer 126 in FIG. 1, a monochrome implementation of which is illustrated in FIG. 7*a*. Referring to FIG. 7*a*, the bitplane data outputted from the data converter are directed to one of the memories (e.g. memory 126*a* or memory 126*b*) of the frame buffer according to subgroups of the memory cells to which the bitplane data are to be written. For example, the bitplane 0 data for the odd numbered pixels (which are outputted consecutively and in parallel from, for example, output lines Out[1], Out[2] . . . . Out[n/2] at time $t_1$ in FIG. 4) are directed to memory 126*a*, while the bitplane 0 data for the even numbered pixels (which are outputted consecutively and in parallel from, for example, output lines Out[(n/2)+1], Out[(n/2)+2] . . . . Out[n] at time $t_1$ in FIG. 4) are directed to memory 126*e*. Similarly, the bitplane 1 data for the odd numbered pixels (which are outputted consecutively and in parallel from, for example, output lines Out[1], Out[2] . . . . Out[n/2] at time $t_2$ in FIG. 4) are directed to memory 126*b*, while the bitplane 1 data for the even numbered pixels (which are outputted consecutively and in parallel from, for example, output lines Out[(n/2)+1], Out[(n/2)+2] . . . . Out[n] at time $t_2$ in FIG. 4) are directed to memory 126*f*. And the bitplane (N−1) data for the odd numbered pixels (which are outputted consecutively and in parallel from, for example, output lines Out[1], Out[2] . . . . Out[n] at time $t_n$ in FIG. 4) are directed to memory 126*d*, while the bitplane (N−1) data (which are outputted consecutively and in parallel from, for example, output lines Out[(n/2)+1], Out[(n/2)+2] . . . Out[n] at time $t_n$ in FIG. 4) for the even numbered pixels are directed to memory 126*h*.

FIG. 7*a* illustrates the storing scheme for the bitplane data for the memory cell array illustrated in FIG. 3*a*, wherein even numbered and odd numbered pixels are connected to separate wordlines. In other alternatives the storing scheme changes in accordance with the connection scheme of the wordlines to the memory cells of the memory cell array. Specifically, the number of regions within the frame buffer corresponds to the number of subgroups defined for each row of the memory cell array or the number of wordlines provided for the memory cells of each row of the memory cell array. And each region is designated for storing the bitplane data of one significance for the memory cells that are activated by a wordline or by the wordlines at one time. It is further preferred that the bitplane data of consecutive significances (e.g. biplane 0 and bitplane 1) for the memory cells to be activated at the same time are stored consecutively. For example, the bitplane 0 for the odd numbered pixels are stored in memory 126*a* and bitplane 1 for the odd numbered pixels are stored in memory 126*b* that is adjacent or consecutive to memory 126*a*. Alternatively, the bitplane data of consecutive significances (e.g. bitplane 0 and bitplane 1) for the pixels in the same subgroup (e.g. the odd numbered pixels) may be stored in non-adjacent memories of a frame buffer region. For example, rather than memory 126*b*, bitplane 1 for odd numbered pixels can be saved in any memory, such as memory 126*c* or 126*d*, of region 126*j*. And the bitplane 0 for the even numbered pixels are stored in memory 126*e* and bitplane 1 for the even numbered pixels are stored in memory 126*f* that is adjacent or consecutive to memory 126*e*.

It is also preferred that the bitplane data of the same significance (e.g. biplane 0) for the memory cells of different subgroups (e.g. the even and the odd numbered pixels) to be activated by separate wordline or at different times are stored in separate regions (e.g. region 126*j* and 126*k* in FIG. 1). For example, the bitplane 0 for the odd numbered pixels and the even numbered pixels are separately stored in regions 126*j* and 126*k*.

An exploded view of a memory (e.g. memory 126*a*) storing a bitplane for odd numbered pixels is illustrated in FIG. 7*b*. Referring to FIG. 7*b*, the bitplane 0 data for the odd numbered pixels are stored according to the spatial positions of the pixels of the spatial light modulator. Specifically, memory 126*j* comprises n rows and m/2 columns, wherein n corresponds to the number of rows of pixels and m corresponds to the number of columns of pixels in the spatial light modulator. For example, in a spatial light modulator comprises 1024×768 pixels, n is 768 and m is 1024. Because the bitplane data for the even numbered pixels and the odd numbered pixels are stored in different regions of the frame buffer, the number of columns in the memory (e.g. memory 126*a*) is m/2. The bitplane data of the same significance are then sequentially stored in the memory. For example, the first row of memory 126*a* consecutively stores the bitplane data of the same significance (e.g. bitplane 0) for the odd numbered pixels of the first row of the spatial light modulator. And the $n^{th}$ row of memory 126*a* consecutively stores the bitplane data of the same significance (e.g. bitplane 0) for the odd numbered pixels of the $n^{th}$ row of the spatial light modulator.

An exploded view of a memory (e.g. memory 126*e*) storing a bitplane for even numbered pixels is illustrated in FIG. 7*c*. The storage scheme for memory 126*a* applies for memory 126*e*, except that memory 126*a* stores the bitplane for the odd numbered pixels, while memory 126*e* stores the bitplane for the odd numbered pixels.

The pixel data and the bitplane data in FIG. 4 are illustrated as square matrices n×n. In practice, the pixel data matrix can be a rectangular matrix with unequal numbers of rows and columns. As a consequence, the bitplane data matrix as a transposed matrix of the pixel data matrix is also a rectangular matrix. As illustrated in the figure, the data bits of the same pixel are arranged in the same column of the pixel data matrix and read at one time. This arrangement scheme, however, is not an absolute requirement. Instead, the data bits of the same pixel may be stored in the same row of the pixel data matrix and read at the same time. Accordingly, the bitplane matrix as a transposed matrix of the pixel data matrix is loaded into the memory cell array row by row.

Figure 8B:
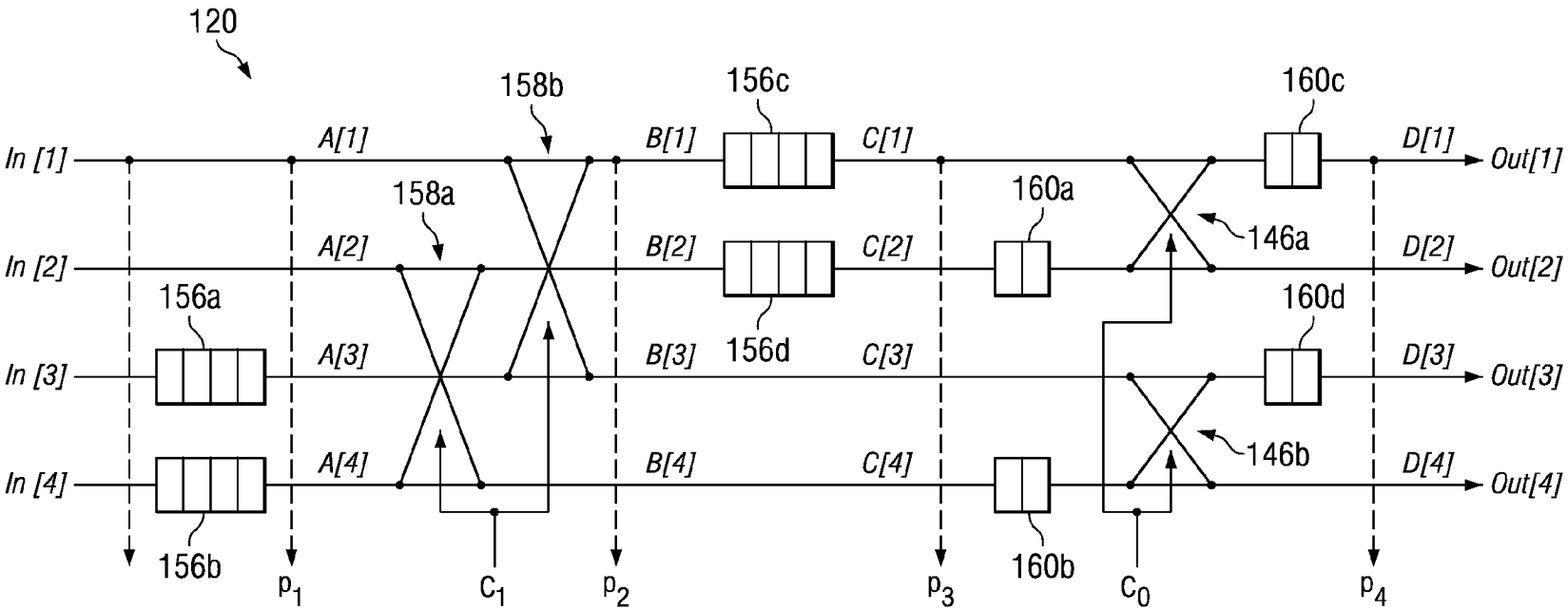
FIG. 8*b* is a block diagram of a data converter of FIG. 1 according to yet another embodiment of the invention.

In order to convert a pixel data matrix into a bitplane matrix, all rows of the pixel data matrix are delivered into the data converter in parallel; and transpose operations are performed on the loaded rows simultaneously. In the following, embodiments of the invention will be discussed with reference to FIG. 5 through FIG. 10. In particular, an embodiment of the invention will be discussed with reference to a 16×8 pixel data matrix in FIG. 5*a*. Another embodiment of the invention will be discussed with reference to FIG. 8*a* and FIG. 8*b* for converting an 8×4 pixel data matrix. The method for transposing 8×4 pixel data matrix in FIG. 8*a* and FIG. 8*b* is extended to transpose a $2^{n+1}\times 2^{n}$ pixel matrix, which will be discussed in detail with reference to FIG. 9. Another embodiment of the invention will be introduced with reference to FIG. 10. This method is particularly useful for transposing a pixel matrix having non-power-of-2 numbers of rows and columns. It is noted that, in practice, pixel data (and also bitplane data) in a row are delivered in time sequence—that is these data are sequentially delivered at different time units. And pixel data (and also bit plane data) in a column are delivered at the same time through, for example, a bit line of the display system. Moreover, in the embodiment of the invention, pixel data are "flowing through" the data processing unit of the display system. The data processing unit receives pixel data in a "real-time" fashion and dynamically performs the predefined transpose operation on the received pixel data. Specifically, the data processing unit receives a column of pixel data at a time-unit and dynamically performs predefined permutations to these received data so as to accomplish the transpose operation. Of course, the pixel data can be stored in a storage medium, such as a frame buffer. The data processing unit then retrieves the stored pixel data and performs the predefined transpose operation on the retrieved pixel data. It should be understood that the embodiments as discussed in the following are for demonstration and clarity purposes only. It should not be interpreted in any ways as a limitation to the present invention. Rather, any suitable methods and apparatus without departing from the spirit of the present invention could be used.

Referring to FIG. 5, a data converter according to an embodiment of the invention is illustrated therein. The mechanism of the transpose operation will be discussed with reference to transforming a 16×8 pixel data matrix, which can be expressed as:

$$\begin{pmatrix}
a_1^1 & a_2^1 & a_3^1 & a_4^1 & a_5^1 & a_6^1 & a_7^1 & a_8^1 & a_9^1 & a_{10}^1 & a_{11}^1 & a_{12}^1 & a_{13}^1 & a_{14}^1 & a_{15}^1 & a_{16}^1 \\
a_1^2 & a_2^2 & a_3^2 & a_4^2 & a_5^2 & a_6^2 & a_7^2 & a_8^2 & a_9^2 & a_{10}^2 & a_{11}^2 & a_{12}^2 & a_{13}^2 & a_{14}^2 & a_{15}^2 & a_{16}^2 \\
a_1^3 & a_2^3 & a_3^3 & a_4^3 & a_5^3 & a_6^3 & a_7^3 & a_8^3 & a_9^3 & a_{10}^3 & a_{11}^3 & a_{12}^3 & a_{13}^3 & a_{14}^3 & a_{15}^3 & a_{16}^3 \\
a_1^4 & a_2^4 & a_3^4 & a_4^4 & a_5^4 & a_6^4 & a_7^4 & a_8^4 & a_9^4 & a_{10}^4 & a_{11}^4 & a_{12}^4 & a_{13}^4 & a_{14}^4 & a_{15}^4 & a_{16}^4 \\
a_1^5 & a_2^5 & a_3^5 & a_4^5 & a_5^5 & a_6^5 & a_7^5 & a_8^5 & a_9^5 & a_{10}^5 & a_{11}^5 & a_{12}^5 & a_{13}^5 & a_{14}^5 & a_{15}^5 & a_{16}^5 \\
a_1^6 & a_2^6 & a_3^6 & a_4^6 & a_5^6 & a_6^6 & a_7^6 & a_8^6 & a_9^6 & a_{10}^6 & a_{11}^6 & a_{12}^6 & a_{13}^6 & a_{14}^6 & a_{15}^6 & a_{16}^6 \\
a_1^7 & a_2^7 & a_3^7 & a_4^7 & a_5^7 & a_6^7 & a_7^7 & a_8^7 & a_9^7 & a_{10}^7 & a_{11}^7 & a_{12}^7 & a_{13}^7 & a_{14}^7 & a_{15}^7 & a_{16}^7 \\
a_1^8 & a_2^8 & a_3^8 & a_4^8 & a_5^8 & a_6^8 & a_7^8 & a_8^8 & a_9^8 & a_{10}^8 & a_{11}^8 & a_{12}^8 & a_{13}^8 & a_{14}^8 & a_{15}^8 & a_{16}^8
\end{pmatrix}$$

The 16×8 pixel data matrix represents 16 pixels of the image (or the 16 pixels of a spatial light modulator), in which the grayscale of each pixel is simulated using 8 bits. The desired bitplane data matrix corresponding to this pixel data matrix according to the embodiment of the invention, in which the bitplane matrix can be directly loaded into the memory cell array having multiple wordlines for each row of memory cells as shown in FIG. 3*a* and/or stored in the frame buffer according to the storing scheme as discussed with reference to FIG. 1 and FIG. 7*a* and FIG. 7*b*, can be expressed as:

$$\begin{pmatrix} a_1^1 & a_1^2 & a_1^3 & a_1^4 & a_1^5 & a_1^6 & a_1^7 & a_1^8 & a_2^1 & a_2^2 & a_2^3 & a_2^4 & a_2^5 & a_2^6 & a_2^7 & a_2^8 \\ a_3^1 & a_3^2 & a_3^3 & a_3^4 & a_3^5 & a_3^6 & a_3^7 & a_3^8 & a_4^1 & a_4^2 & a_4^3 & a_4^4 & a_4^5 & a_4^6 & a_4^7 & a_4^2 \\ a_5^1 & a_5^2 & a_5^3 & a_5^4 & a_5^5 & a_5^6 & a_5^7 & a_5^8 & a_6^1 & a_6^2 & a_6^3 & a_6^4 & a_6^5 & a_6^6 & a_6^7 & a_6^3 \\ a_7^1 & a_7^2 & a_7^3 & a_7^4 & a_7^5 & a_7^6 & a_7^7 & a_7^8 & a_8^1 & a_8^2 & a_8^3 & a_8^4 & a_8^5 & a_8^6 & a_8^7 & a_8^4 \\ a_9^1 & a_9^2 & a_9^3 & a_9^4 & a_9^5 & a_9^6 & a_9^7 & a_9^8 & a_{10}^1 & a_{10}^2 & a_{10}^3 & a_{10}^4 & a_{10}^5 & a_{10}^6 & a_{10}^7 & a_{10}^5 \\ a_{11}^1 & a_{11}^2 & a_{11}^3 & a_{11}^4 & a_{11}^5 & a_{11}^6 & a_{11}^7 & a_{11}^8 & a_{12}^1 & a_{12}^2 & a_{12}^3 & a_{12}^4 & a_{12}^5 & a_{12}^6 & a_{12}^7 & a_{12}^6 \\ a_{13}^1 & a_{13}^2 & a_{13}^3 & a_{13}^4 & a_{13}^5 & a_{13}^6 & a_{13}^7 & a_{13}^8 & a_{14}^1 & a_{14}^2 & a_{14}^3 & a_{14}^4 & a_{14}^5 & a_{14}^6 & a_{14}^7 & a_{14}^7 \\ a_{15}^1 & a_{15}^2 & a_{15}^3 & a_{15}^4 & a_{15}^5 & a_{15}^6 & a_{15}^7 & a_{15}^8 & a_{16}^1 & a_{16}^2 & a_{16}^3 & a_{16}^4 & a_{16}^5 & a_{16}^6 & a_{16}^7 & a_{16}^8 \end{pmatrix}$$

It can be seen from the above bitplane data matrix that bitplane data for the odd numbered pixels 1, 3, 5, 7, 9, 11, 13 and 15 are arranged in adjacent rows, such as rows 1 through 8. And the bitplane of the same significance are arranged in the same column. For example, bitplate data of bitplane 1 for the odd numbered pixels are in column 1 of the matrix. Similarly, bitplane data for the even numbered pixels 2, 4, 6, 8, 10, 12, 14 and 16 are arranged in adjacent rows, such as rows 1 through 8. And the bitplane of the same significance are arranged in the same column. For example, bitplane data of bitplane 1 for the even numbered pixels are in column 9 of the matrix. The bitplane data for the even numbered pixels and the odd numbered pixels are in different groups of the matrix. For example, the bitplane data for the odd numbered pixels are in columns 1 through 8, while the bitplane data for the even numbered pixels are in the columns 9 through 16. This bitplane data matrix format corresponds to the wordline configuration in memory cell array in FIG. 3*a*.

Figure 5A:
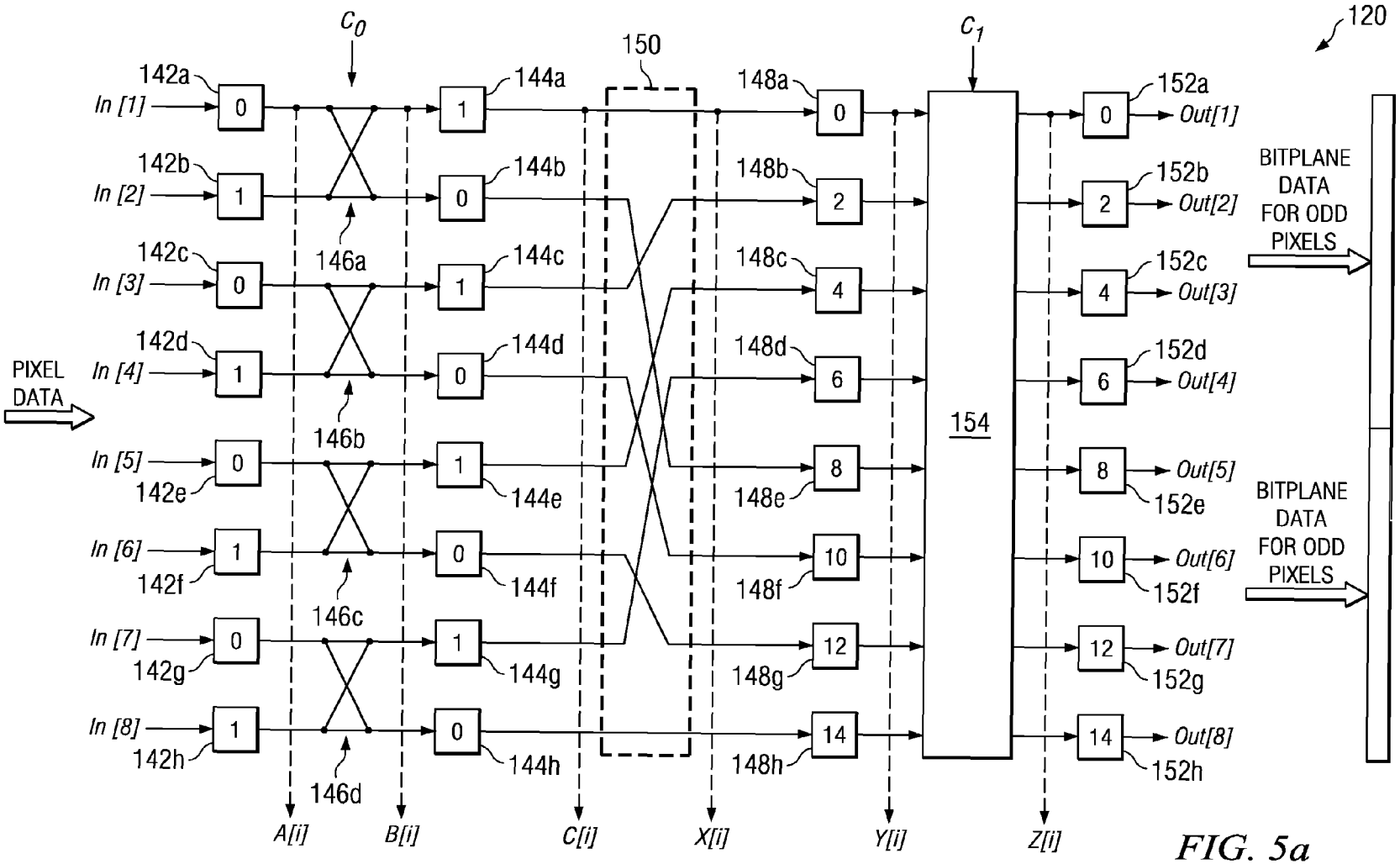
FIG. 5*a* illustrates a diagram of a data converter of FIG. 1 according to an embodiment of the invention.

In order to transpose the above pixel data matrix into the above defined bitplane data matrix, data converter 120 in FIG. 5*a* is provided. The data converter comprises a plurality of input lines, In[1], In[2], In[3], In[4], In[5], In[6], In[7] and In[8]. Each input line is designated for dynamically receiving a pixel data in a row of the pixel data matrix at a time. The received data by the input lines are processed dynamically. The process of the received pixel data at a time by the input lines is independent from the previous processes for the previously received data and from the processes for the following or the rest pixel data of the matrix. After the transformation process, the received data at the time are outputted by the output lines Out[1], Out[2], Out[3], Out[4], Out[5], Out[6], Out[7] and Out[8], according to the desired format. This output operation is also independent from the previous output operations for the previously processed data and from the following outputs and/or following processes for the following or the rest pixel data of the matrix.

In operation, the data converter is associated with a sequence of time-units, each of which may be one or a multiple of clock cycles. For example, a XGA (1024×768) video signal typically has a pixel clock of 65 MHz, or a clock period of 15.1 nanoseconds. In this case, the time-unit is preferably 15.1 nanoseconds, or a multiple of 15.1 nanoseconds. The input lines and the output lines are synchronized with a sequence of time-units, each of which is a multiple of the clock cycle. Data elements passing through the data converter are associated with the sequence of time-units. Specifically, the pixel data received at a time by the input lines are synchronized. By "data elements are synchronized", it is meant that there is no time delay between the data elements with reference to a common time sequence. That is, at the same time unit, the synchronized data arrive at the same cross-section of all input lines (or the pipe lines within the data converter, wherein the pipeline is an extension of an input line and out put line that corresponds to the input line and connects the input line and the output line). The pixel data of a row of the pixel data matrix are delivered sequentially into an input line with reference to the sequence of the time units.

The received pixel data, such as the pixel data at a column i by the input lines In[1] through In[8] are respectively passed through delay units 142*a* through 142*h*. Specifically, pixel data $[a_i^1, a_i^2, a_i^3, a_i^4, a_i^5, a_i^6, a_i^7, a_i^8]$ of the $i^{th}$ pixel are respectively received by the input lines In[1], In[2], In[3], In[4], In[5], In[6], In[7] and In[8], and are respectively passed through the delay units 142*a*, 142*b*, 142*c*, 142*d*, 142*e*, 142*f*, 142*g* and 142*h*. According to the invention, the delay unit is a standard flipflop circuit. Other suitable circuits fulfilling the same function may also be used. The delay units delay the received data according to a predefined delay scheme. Specifically, the delay units delay the data received by the even numbered input lines one time unit relative to the data received by the odd numbered input lines. Specifically, delay units 142*b*, 142*d*, 142*f* and 142*h* delay the data received by input lines (for receiving the pixel data of the even numbered rows of the pixel matrix) In[2], In[4], In[6] and In[8] on time unit relative to the data received by the input lines (for receiving the pixel data of the odd numbered rows of the pixel matrix) In[1], In[3], In[5] and In[7]. Table 1 lists the data elements at the pipelines after the delay units 142*a* through 142*h*.

TABLE 1

| Time | A[1] | A[2] | A[3] | A[4] | A[5] | A[6] | A[7] | A[8] |
|---|---|---|---|---|---|---|---|---|
| 0 | $a_1^1$ | | $a_1^3$ | | $a_1^5$ | | $a_1^7$ | |
| 1 | $a_2^1$ | $a_1^2$ | $a_2^3$ | $a_1^4$ | $a_2^5$ | $a_1^6$ | $a_2^7$ | $a_1^8$ |
| 2 | $a_3^1$ | $a_2^2$ | $a_3^3$ | $a_2^4$ | $a_3^5$ | $a_2^6$ | $a_3^7$ | $a_2^8$ |
| 3 | $a_4^1$ | $a_3^2$ | $a_4^3$ | $a_3^4$ | $a_4^5$ | $a_3^6$ | $a_4^7$ | $a_3^8$ |
| 4 | $a_5^1$ | $a_4^2$ | $a_5^3$ | $a_4^4$ | $a_5^5$ | $a_4^6$ | $a_5^7$ | $a_4^8$ |
| 5 | $a_6^1$ | $a_5^2$ | $a_6^3$ | $a_5^4$ | $a_6^5$ | $a_5^6$ | $a_6^7$ | $a_5^8$ |
| 6 | $a_7^1$ | $a_6^2$ | $a_7^3$ | $a_6^4$ | $a_7^5$ | $a_6^6$ | $a_7^7$ | $a_6^8$ |
| 7 | $a_8^1$ | $a_7^2$ | $a_8^3$ | $a_7^4$ | $a_8^5$ | $a_7^6$ | $a_8^7$ | $a_7^8$ |
| 8 | $a_9^1$ | $a_8^2$ | $a_9^3$ | $a_8^4$ | $a_9^5$ | $a_8^6$ | $a_9^7$ | $a_8^8$ |
| 9 | $a_{10}^1$ | $a_9^2$ | $a_{10}^3$ | $a_9^4$ | $a_{10}^5$ | $a_9^6$ | $a_{10}^7$ | $a_9^8$ |
| 10 | $a_{11}^1$ | $a_{10}^2$ | $a_{11}^3$ | $a_{10}^4$ | $a_{11}^5$ | $a_{10}^6$ | $a_{11}^7$ | $a_{10}^8$ |
| 11 | $a_{12}^1$ | $a_{11}^2$ | $a_{12}^3$ | $a_{11}^4$ | $a_{12}^5$ | $a_{11}^6$ | $a_{12}^7$ | $a_{11}^8$ |
| 12 | $a_{13}^1$ | $a_{12}^2$ | $a_{13}^3$ | $a_{12}^4$ | $a_{13}^5$ | $a_{12}^6$ | $a_{13}^7$ | $a_{12}^8$ |
| 13 | $a_{14}^1$ | $a_{13}^2$ | $a_{14}^3$ | $a_{13}^4$ | $a_{14}^5$ | $a_{13}^6$ | $a_{14}^7$ | $a_{13}^8$ |
| 14 | $a_{15}^1$ | $a_{14}^2$ | $a_{15}^3$ | $a_{14}^4$ | $a_{15}^5$ | $a_{14}^6$ | $a_{15}^7$ | $a_{14}^8$ |
| 15 | $a_{14}^1$ | $a_{15}^2$ | $a_{16}^3$ | $a_{15}^4$ | $a_{16}^5$ | $a_{15}^6$ | $a_{16}^7$ | $a_{15}^8$ |
| 16 | | $a_{16}^2$ | | $a_{16}^4$ | | $a_{16}^6$ | | $a_{16}^8$ |

wherein "TIME" represents the sequence of time units.

Figure 6:
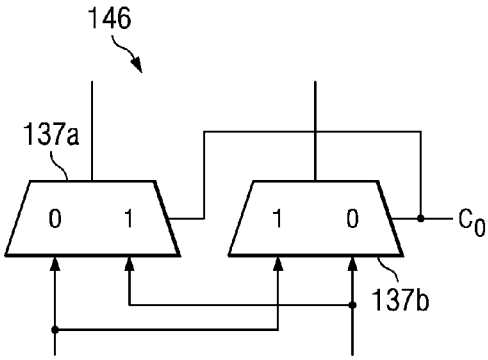
FIG. 6 is a diagram illustrates an exemplary switch unit of FIG. 5.

After the delay units 142*a* through 142*h*, the data elements are permuted by switches 146*a*, 146*b*, 146*c* and 146*d* in response to an activation signal $C_0$. The switch exchanges the data elements between the pipelines connected to the switch at certain time units. For example, when time t is odd, switch 146*a* exchanges the data elements at A[1] and A[2] such that the data element on A[1] before the switch is delivered to B[2] after the switch, wherein B[2] is the cross-point of pipeline 2 and the cross-line B[i]. The data element on A[2] before the switch is delivered to B[f] after the switch. When t is even, A[1] is passed through to B[f] and A[2] is passed through to B[2]. Similar permutations occur between the pipeline pairs 3 and 4, 5 and 6, 7 and 8. An exemplary switch (e.g. switch 146*a*) is illustrated in FIG. 6. As can be seen in FIG. 6, switch 146 consists of two juxtaposed multiplexers 137*a* and 137*b*, both are connected to an activation signal $C_0$. In the embodiment of the invention, the activation signal toggles every time-unit (e.g. every clock cycle when the time-unit equals one clock cycle). In response to the activation signal $C_0$, the two multiplexers exchange input data bits and outputs exchanged data bits. Of course, other suitable switch circuits may also be applied. Table 2 lists the states of the data after the permutation by the switches 146*a* through 146*d*.

TABLE 2

| Time | B[1] | B[2] | B[3] | B[4] | B[5] | B[6] | B[7] | B[8] |
|---|---|---|---|---|---|---|---|---|
| 0 | $a_1^1$ | | $a_1^3$ | | $a_1^5$ | | $a_1^7$ | |
| 1 | $a_1^2$ | $a_2^1$ | $a_1^4$ | $a_2^3$ | $a_1^6$ | $a_2^5$ | $a_1^8$ | $a_2^7$ |
| 2 | $a_3^1$ | $a_2^2$ | $a_3^3$ | $a_2^4$ | $a_3^5$ | $a_2^6$ | $a_3^7$ | $a_2^8$ |
| 3 | $a_3^2$ | $a_4^1$ | $a_3^4$ | $a_4^3$ | $a_3^6$ | $a_4^5$ | $a_3^8$ | $a_4^7$ |
| 4 | $a_5^1$ | $a_4^2$ | $a_5^3$ | $a_4^4$ | $a_5^5$ | $a_4^6$ | $a_5^7$ | $a_4^8$ |
| 5 | $a_5^2$ | $a_6^1$ | $a_5^4$ | $a_6^3$ | $a_5^6$ | $a_6^5$ | $a_5^8$ | $a_6^7$ |
| 6 | $a_7^1$ | $a_6^2$ | $a_7^3$ | $a_6^4$ | $a_7^5$ | $a_6^6$ | $a_7^7$ | $a_6^8$ |
| 7 | $a_7^2$ | $a_8^1$ | $a_7^4$ | $a_8^3$ | $a_7^6$ | $a_8^5$ | $a_7^8$ | $a_8^7$ |
| 8 | $a_9^1$ | $a_8^2$ | $a_9^3$ | $a_8^4$ | $a_9^5$ | $a_8^6$ | $a_9^7$ | $a_8^8$ |
| 9 | $a_9^2$ | $a_{10}^1$ | $a_9^4$ | $a_{10}^3$ | $a_9^6$ | $a_{10}^5$ | $a_9^8$ | $a_{10}^7$ |
| 10 | $a_{11}^1$ | $a_{10}^2$ | $a_{11}^3$ | $a_{10}^4$ | $a_{11}^5$ | $a_{10}^6$ | $a_{11}^7$ | $a_{10}^8$ |
| 11 | $a_{11}^2$ | $a_{12}^1$ | $a_{11}^4$ | $a_{12}^3$ | $a_{11}^6$ | $a_{12}^5$ | $a_{11}^8$ | $a_{12}^7$ |
| 12 | $a_{13}^1$ | $a_{12}^2$ | $a_{13}^3$ | $a_{12}^4$ | $a_{13}^5$ | $a_{12}^6$ | $a_{13}^7$ | $a_{12}^8$ |
| 13 | $a_{13}^2$ | $a_{14}^1$ | $a_{13}^4$ | $a_{14}^3$ | $a_{13}^6$ | $a_{14}^5$ | $a_{13}^8$ | $a_{14}^7$ |
| 14 | $a_{15}^1$ | $a_{14}^2$ | $a_{15}^3$ | $a_{14}^4$ | $a_{15}^5$ | $a_{14}^6$ | $a_{15}^7$ | $a_{14}^8$ |
| 15 | $a_{15}^2$ | $a_{14}^1$ | $a_{15}^4$ | $a_{16}^3$ | $a_{15}^6$ | $a_{16}^5$ | $a_{15}^8$ | $a_{16}^7$ |
| 16 | | $a_{16}^2$ | | $a_{16}^4$ | | $a_{16}^6$ | | $a_{16}^8$ |

After the switches 146*a* through 146*d*, the permutated data elements are then passed through delay units 144*a* through 144*h*. According to the invention, the delay unit is a standard flipflop circuit. Other suitable circuits fulfilling the same function may also be used. The delay units delay the received data according to a predefined delay scheme. Specifically, the delay units delay the data at the odd indexed pipelines one time unit relative to the data elements at the even indexed pipelines. Specifically, delay units 144*a*, 144*c*, 144*e* and 144*g* delay the data at the pipe lines 1, 3, 5 and 7 on time unit relative to the data at the pipe lines 2, 4, 6 and 8. Table 3 lists the data elements at the pipelines after the delay units 144*a* through 144*h*.

TABLE 3

| Time | C[1] | C[2] | C[3] | C[4] | C[5] | C[6] | C[7] | C[8] |
|---|---|---|---|---|---|---|---|---|
| 0 | | | | | | | | |
| 1 | $a_1^1$ | $a_2^1$ | $a_1^3$ | $a_2^3$ | $a_1^5$ | $a_2^5$ | $a_1^7$ | $a_2^7$ |
| 2 | $a_1^2$ | $a_2^2$ | $a_1^4$ | $a_2^4$ | $a_1^6$ | $a_2^6$ | $a_1^8$ | $a_2^8$ |
| 3 | $a_3^1$ | $a_4^1$ | $a_3^3$ | $a_4^3$ | $a_3^5$ | $a_4^5$ | $a_3^7$ | $a_4^7$ |
| 4 | $a_3^2$ | $a_4^2$ | $a_3^4$ | $a_4^4$ | $a_3^6$ | $a_4^6$ | $a_3^8$ | $a_4^8$ |
| 5 | $a_5^1$ | $a_6^1$ | $a_5^3$ | $a_6^3$ | $a_5^5$ | $a_6^5$ | $a_5^7$ | $a_6^7$ |
| 6 | $a_5^2$ | $a_6^2$ | $a_5^4$ | $a_6^4$ | $a_5^6$ | $a_6^6$ | $a_5^8$ | $a_6^8$ |
| 7 | $a_7^1$ | $a_8^1$ | $a_7^3$ | $a_8^3$ | $a_7^5$ | $a_8^5$ | $a_7^7$ | $a_8^7$ |
| 8 | $a_7^2$ | $a_8^2$ | $a_7^4$ | $a_8^4$ | $a_7^6$ | $a_8^6$ | $a_7^8$ | $a_8^8$ |
| 9 | $a_9^1$ | $a_{10}^1$ | $a_9^3$ | $a_{10}^3$ | $a_9^5$ | $a_{10}^5$ | $a_9^7$ | $a_{10}^7$ |
| 10 | $a_9^2$ | $a_{10}^2$ | $a_9^4$ | $a_{10}^4$ | $a_9^6$ | $a_{10}^6$ | $a_9^8$ | $a_{10}^8$ |
| 11 | $a_{11}^1$ | $a_{12}^1$ | $a_{11}^3$ | $a_{12}^3$ | $a_{11}^5$ | $a_{12}^5$ | $a_{11}^7$ | $a_{12}^7$ |
| 12 | $a_{11}^2$ | $a_{12}^2$ | $a_{11}^4$ | $a_{12}^4$ | $a_{11}^6$ | $a_{12}^6$ | $a_{11}^8$ | $a_{12}^8$ |
| 13 | $a_{13}^1$ | $a_{14}^1$ | $a_{13}^3$ | $a_{14}^3$ | $a_{13}^5$ | $a_{14}^5$ | $a_{13}^7$ | $a_{14}^7$ |
| 14 | $a_{13}^2$ | $a_{14}^2$ | $a_{13}^4$ | $a_{14}^4$ | $a_{13}^6$ | $a_{14}^6$ | $a_{13}^8$ | $a_{14}^8$ |
| 15 | $a_{15}^1$ | $a_{14}^1$ | $a_{15}^3$ | $a_{16}^3$ | $a_{15}^5$ | $a_{16}^5$ | $a_{15}^7$ | $a_{16}^7$ |
| 16 | $a_{15}^2$ | $a_{16}^2$ | $a_{15}^4$ | $a_{16}^4$ | $a_{15}^6$ | $a_{16}^6$ | $a_{15}^8$ | $a_{16}^8$ |

After the delay units 144*a* through 144*h*, the delayed data are permuted according to a predefined permutation rule by switch 150. The permutation is the inverse operation of a standard "perfect shuffle" operation. Specifically, the data at pipeline 1 is passed through without permutation. The data at pipeline 2 is passed to pipe line 5. The data at pipeline 3 is passed to pipe line 2. The data at pipeline 4 is passed to pipe line 6. The data at pipeline 5 is passed to pipe line 4. The data at pipeline 6 is passed to pipe line 7. The data at pipeline 7 is passed to pipe line 4. And the data at pipeline 8 is passed through without change. The status of the data elements at the pipelines after switch 150 is illustrated in table 4.

TABLE 4

| Time | X[1] | X[2] | X[3] | X[4] | X[5] | X[6] | X[7] | X[8] |
|---|---|---|---|---|---|---|---|---|
| 0 | | | | | | | | |
| 1 | $a_1^1$ | $a_1^3$ | $a_1^5$ | $a_1^7$ | $a_2^1$ | $a_2^3$ | $a_2^5$ | $a_2^7$ |
| 2 | $a_1^2$ | $a_1^4$ | $a_1^6$ | $a_1^8$ | $a_2^2$ | $a_2^4$ | $a_2^6$ | $a_2^8$ |
| 3 | $a_3^1$ | $a_3^3$ | $a_3^5$ | $a_3^7$ | $a_4^1$ | $a_4^3$ | $a_4^5$ | $a_4^7$ |
| 4 | $a_3^2$ | $a_3^4$ | $a_3^6$ | $a_3^8$ | $a_4^2$ | $a_4^4$ | $a_4^6$ | $a_4^8$ |
| 5 | $a_5^1$ | $a_5^3$ | $a_5^5$ | $a_5^7$ | $a_6^1$ | $a_6^3$ | $a_6^5$ | $a_6^7$ |
| 6 | $a_5^2$ | $a_5^4$ | $a_5^6$ | $a_5^8$ | $a_6^2$ | $a_6^4$ | $a_6^6$ | $a_6^8$ |
| 7 | $a_7^1$ | $a_7^3$ | $a_7^5$ | $a_7^7$ | $a_8^1$ | $a_8^3$ | $a_8^5$ | $a_8^7$ |
| 8 | $a_7^2$ | $a_7^4$ | $a_7^6$ | $a_7^8$ | $a_8^2$ | $a_8^4$ | $a_8^6$ | $a_8^8$ |
| 9 | $a_9^1$ | $a_9^3$ | $a_9^5$ | $a_9^7$ | $a_{10}^1$ | $a_{10}^3$ | $a_{10}^5$ | $a_{10}^7$ |
| 10 | $a_9^2$ | $a_9^4$ | $a_9^6$ | $a_9^8$ | $a_{10}^2$ | $a_{10}^4$ | $a_{10}^6$ | $a_{10}^8$ |
| 11 | $a_{11}^1$ | $a_{11}^3$ | $a_{11}^5$ | $a_{11}^7$ | $a_{12}^1$ | $a_{12}^3$ | $a_{12}^5$ | $a_{12}^7$ |
| 12 | $a_{11}^2$ | $a_{11}^4$ | $a_{11}^6$ | $a_{11}^8$ | $a_{12}^2$ | $a_{12}^4$ | $a_{12}^6$ | $a_{12}^8$ |
| 13 | $a_{13}^1$ | $a_{13}^3$ | $a_{13}^5$ | $a_{13}^7$ | $a_{14}^1$ | $a_{14}^3$ | $a_{14}^5$ | $a_{14}^7$ |
| 14 | $a_{13}^2$ | $a_{13}^4$ | $a_{13}^6$ | $a_{13}^8$ | $a_{14}^2$ | $a_{14}^4$ | $a_{14}^6$ | $a_{14}^8$ |
| 15 | $a_{15}^1$ | $a_{15}^3$ | $a_{15}^5$ | $a_{15}^7$ | $a_{14}^1$ | $a_{16}^3$ | $a_{16}^5$ | $a_{16}^7$ |
| 16 | $a_{15}^2$ | $a_{15}^4$ | $a_{15}^6$ | $a_{15}^8$ | $a_{16}^2$ | $a_{16}^4$ | $a_{16}^6$ | $a_{16}^8$ |

The switched data elements by switch 150 are then passed through delay units 148*a* through 148*h*. According to the invention, the delay unit is a standard flip-flop circuit. Other suitable circuit fulfills the same function may also be used. The delay units delay the data elements at the pipelines according to a predefined delay scheme. Specifically, the delay unit at pipeline i delay the data elements at the pipeline i 2×i−2 time units relative to the data elements at the pipeline 1. Specifically, delay units 148*b* at pipeline 2 delays the data at pipeline 2 two time units relative to the data at the pipeline 1. Delay units 148*c* at pipeline 3 delays the data at pipeline 3 four time units relative to the data at the pipeline 1. Delay units 148*d* at pipeline 4 delays the data at pipeline 4 six time units relative to the data at the pipeline 1. Delay units 148*e* at pipeline 5 delays the data at pipeline 5 eight time units relative to the data at the pipeline 1. Delay units 148*f* at pipeline 6 delays the data at pipeline 6 ten time units relative to the data at the pipeline 1. Delay units 148*g* at pipeline 7 delays the data at pipeline 7 twelve time units relative to the data at the pipeline 1. Delay units 148*h* at pipeline 8 delays the data at pipeline 8 fourteen time units relative to the data at the pipeline 1. The delayed data elements at the pipelines after delay units 148*a* through 148*h* are illustrated in table 5.

TABLE 5

| Time | Y[1] | Y[2] | Y[3] | Y[4] | Y[5] | Y[6] | Y[7] | Y[8] |
|---|---|---|---|---|---|---|---|---|
| 0 | | | | | | | | |
| 1 | $a_1^1$ | | | | | | | |
| 2 | $a_1^2$ | | | | | | | |
| 3 | $a_3^1$ | $a_1^3$ | | | | | | |
| 4 | $a_3^2$ | $a_1^4$ | | | | | | |
| 5 | $a_5^1$ | $a_3^3$ | $a_1^5$ | | | | | |
| 6 | $a_5^2$ | $a_3^4$ | $a_1^6$ | | | | | |
| 7 | $a_7^1$ | $a_5^3$ | $a_3^5$ | $a_1^7$ | | | | |
| 8 | $a_7^2$ | $a_5^4$ | $a_3^6$ | $a_1^8$ | | | | |
| 9 | $a_9^1$ | $a_7^3$ | $a_5^5$ | $a_3^7$ | $a_2^1$ | | | |
| 10 | $a_9^2$ | $a_7^4$ | $a_5^6$ | $a_3^8$ | $a_2^2$ | | | |
| 11 | $a_{11}^1$ | $a_9^3$ | $a_7^5$ | $a_5^7$ | $a_4^1$ | $a_2^3$ | | |
| 12 | $a_{11}^2$ | $a_9^4$ | $a_7^6$ | $a_5^8$ | $a_4^2$ | $a_2^4$ | | |
| 13 | $a_{13}^1$ | $a_{11}^3$ | $a_9^5$ | $a_7^7$ | $a_6^1$ | $a_4^3$ | $a_2^5$ | |
| 14 | $a_{13}^2$ | $a_{11}^4$ | $a_9^6$ | $a_7^8$ | $a_6^2$ | $a_4^4$ | $a_2^6$ | |
| 15 | $a_{15}^1$ | $a_{13}^3$ | $a_{11}^5$ | $a_9^7$ | $a_8^1$ | $a_6^3$ | $a_4^5$ | $a_2^7$ |
| 16 | $a_{15}^2$ | $a_{13}^4$ | $a_{11}^6$ | $a_9^8$ | $a_8^2$ | $a_6^4$ | $a_4^6$ | $a_2^8$ |
| 17 | | $a_{15}^3$ | $a_{13}^5$ | $a_{11}^7$ | $a_{10}^1$ | $a_8^3$ | $a_6^5$ | $a_4^7$ |
| 18 | | $a_{15}^4$ | $a_{13}^6$ | $a_{11}^8$ | $a_{10}^2$ | $a_8^4$ | $a_6^6$ | $a_4^8$ |
| 19 | | | $a_{15}^5$ | $a_{13}^7$ | $a_{12}^1$ | $a_{10}^3$ | $a_8^5$ | $a_6^7$ |
| 20 | | | $a_{15}^6$ | $a_{13}^8$ | $a_{12}^2$ | $a_{10}^4$ | $a_8^6$ | $a_6^8$ |
| 21 | | | | $a_{15}^7$ | $a_{14}^1$ | $a_{12}^3$ | $a_{10}^5$ | $a_8^7$ |
| 22 | | | | $a_{15}^8$ | $a_{14}^2$ | $a_{12}^4$ | $a_{10}^6$ | $a_8^8$ |
| 23 | | | | | $a_{14}^1$ | $a_{14}^3$ | $a_{12}^5$ | $a_{10}^7$ |
| 24 | | | | | $a_{16}^2$ | $a_{14}^4$ | $a_{12}^6$ | $a_{10}^8$ |
| 25 | | | | | | $a_{16}^3$ | $a_{14}^5$ | $a_{12}^7$ |
| 26 | | | | | | $a_{16}^4$ | $a_{14}^6$ | $a_{12}^8$ |
| 27 | | | | | | | $a_{16}^5$ | $a_{14}^7$ |
| 28 | | | | | | | $a_{16}^6$ | $a_{14}^8$ |
| 29 | | | | | | | | $a_{16}^7$ |
| 30 | | | | | | | | $a_{16}^8$ |

Figure 5B:
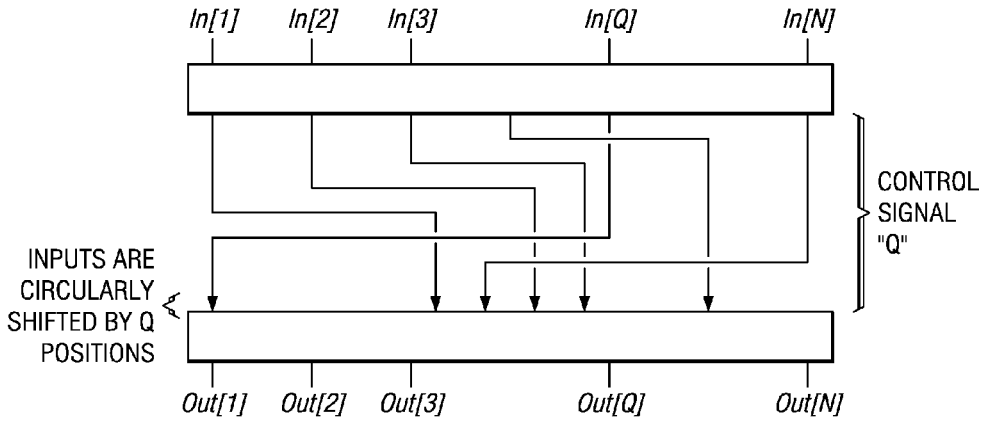
FIG. 5*b* illustrates a structure of a barrel shifter used in the data converter of FIG. 5*a;*

After delay units 148*a* through 148*h*, the delayed data elements are delivered to shifter 154, which is preferably a barrel shifter that is controlled by an activation signal $C_1$. Under control of a set of control signals, the barrel shifter provides on its output a circularly rotated version of its inputs, where the number of positions the data is rotated is determined by the control inputs. An exemplary barrel shifter is illustrated in FIG. 5*b*. Referring to FIG. 5*b*, the barrel shifter comprises N inputs, represented by In[1], In[2], through In[N], and N outputs, represented by Out[1] through Out[N]. In response to a control signal "Q", the N input data are circularly rotated with Q positions as shown in the figure, wherein Q is an integer less than N. Referring back to FIG. 5, eight input lines and eight out lines are illustrated in the barrel shifter in the figure. The status of the data elements flowing in the pipelines after shifter 154 are listed in table 6.

TABLE 6

| Time | Z[1] | Z[2] | Z[3] | Z[4] | Z[5] | Z[6] | Z[7] | Z[8] |
|---|---|---|---|---|---|---|---|---|
| 0 | | | | | | | | |
| 1 | | | | | | | | $a_1^1$ |
| 2 | | | | | | | | $a_1^2$ |
| 3 | | | | | | | $a_3^1$ | $a_1^3$ |
| 4 | | | | | | | $a_3^2$ | $a_1^4$ |
| 5 | | | | | | $a_5^1$ | $a_3^3$ | $a_1^5$ |
| 6 | | | | | | $a_5^2$ | $a_3^4$ | $a_1^6$ |
| 7 | | | | | $a_7^1$ | $a_5^3$ | $a_3^5$ | $a_1^7$ |
| 8 | | | | | $a_7^2$ | $a_5^4$ | $a_3^6$ | $a_1^8$ |
| 9 | | | | $a_9^1$ | $a_7^3$ | $a_5^5$ | $a_3^7$ | $a_2^1$ |
| 10 | | | | $a_9^2$ | $a_7^4$ | $a_5^6$ | $a_3^8$ | $a_2^2$ |
| 11 | | | $a_{11}^1$ | $a_9^3$ | $a_7^5$ | $a_5^7$ | $a_4^1$ | $a_2^3$ |
| 12 | | | $a_{11}^2$ | $a_9^4$ | $a_7^6$ | $a_5^8$ | $a_4^2$ | $a_2^4$ |
| 13 | | $a_{13}^1$ | $a_{11}^3$ | $a_9^5$ | $a_7^7$ | $a_6^1$ | $a_4^3$ | $a_2^5$ |
| 14 | | $a_{13}^2$ | $a_{11}^4$ | $a_9^6$ | $a_7^8$ | $a_6^2$ | $a_4^4$ | $a_2^6$ |
| 15 | $a_{15}^1$ | $a_{13}^3$ | $a_{11}^5$ | $a_9^7$ | $a_8^1$ | $a_6^3$ | $a_4^5$ | $a_2^7$ |
| 16 | $a_{15}^2$ | $a_{13}^4$ | $a_{11}^6$ | $a_9^8$ | $a_8^2$ | $a_6^4$ | $a_4^6$ | $a_2^8$ |
| 17 | $a_{15}^3$ | $a_{13}^5$ | $a_{11}^7$ | $a_{10}^1$ | $a_8^3$ | $a_6^5$ | $a_4^7$ | |
| 18 | $a_{15}^4$ | $a_{13}^6$ | $a_{11}^8$ | $a_{10}^2$ | $a_8^4$ | $a_6^6$ | $a_4^8$ | |

TABLE 6-continued

| Time | Z[1] | Z[2] | Z[3] | Z[4] | Z[5] | Z[6] | Z[7] | Z[8] |
|---|---|---|---|---|---|---|---|---|
| 19 | $a_{15}^5$ | $a_{13}^7$ | $a_{12}^1$ | $a_{10}^3$ | $a_8^5$ | $a_6^7$ | | |
| 20 | $a_{15}^6$ | $a_{13}^8$ | $a_{12}^2$ | $a_{10}^4$ | $a_8^6$ | $a_6^8$ | | |
| 21 | $a_{15}^7$ | $a_{14}^1$ | $a_{12}^3$ | $a_{10}^5$ | $a_8^7$ | | | |
| 22 | $a_{15}^8$ | $a_{14}^2$ | $a_{12}^4$ | $a_{10}^6$ | $a_8^8$ | | | |
| 23 | $a_{16}^1$ | $a_{14}^3$ | $a_{12}^5$ | $a_{10}^7$ | | | | |
| 24 | $a_{16}^2$ | $a_{14}^4$ | $a_{12}^6$ | $a_{10}^8$ | | | | |
| 25 | $a_{16}^3$ | $a_{14}^5$ | $a_{12}^7$ | | | | | |
| 26 | $a_{16}^4$ | $a_{14}^6$ | $a_{12}^8$ | | | | | |
| 27 | $a_{16}^5$ | $a_{14}^7$ | | | | | | |
| 28 | $a_{16}^6$ | $a_{14}^8$ | | | | | | |
| 29 | $a_{16}^7$ | | | | | | | |
| 30 | $a_{16}^8$ | | | | | | | |

The data elements after shifter 154 are then delayed by delay units 152*a* through 152*h*. According to the invention, the delay unit is a standard flipflop circuit. Other suitable circuit fulfills the same function may also be used. The delay units delay the data elements at the pipelines according to a predefined delay scheme. Specifically, the delay unit at pipeline i delay the data elements at the pipeline i $2\times i-2$ time units relative to the data elements at the pipeline 1. Specifically, delay units 152*b* at pipeline 2 delays the data at pipeline 2 two time units relative to the data at the pipeline 1. Delay units 152*c* at pipeline 3 delays the data at pipeline 3 four time units relative to the data at the pipeline 1. Delay units 152*d* at pipeline 4 delays the data at pipeline 4 six time units relative to the data at the pipeline 1. Delay units 152*e* at pipeline 5 delays the data at pipeline 5 eight time units relative to the data at the pipeline 1. Delay units 152*f* at pipeline 6 delays the data at pipeline 6 ten time units relative to the data at the pipeline 1. Delay units 152*g* at pipeline 7 delays the data at pipeline 7 twelve time units relative to the data at the pipeline 1. Delay units 152*h* at pipeline 8 delays the data at pipeline 8 fourteen time units relative to the data at the pipeline 1.

After the delay units 152 through 152*h*, desired bitplane data matrix is obtained and outputted by the outlines lines Out[1] through Out[8]. Specifically, all output lines Out[1] through Out[8] output the bitplane data for the odd numbered pixels {1, 3, 5, 7, 9, 11, 13, 15} and write the bitplane for the odd numbered pixels in the region designated for storing the bitplane data for odd numbered pixels in the frame buffer. For example, bitplane data set $[a_i^j, a_{i+2}^j, a_{i+4}^j, a_{i+6}^j, a_{i+8}^j, a_{i+10}^j, a_{i+12}^j, a_{i+14}^j]$ are respectively outputted in parallel by output lines Out[1] through Out[8] as i=1 and j=1 at a first time unit. At a second time unit following the first time unit, the data set with i=1 and j=2 are respectively outputted in parallel by output lines Out[1] through Out[8]. After the bitplane data for all odd numbered pixels are outputted and written to the corresponding storage region in frame buffer, the bitplane data for the even numbered pixels are outputted and written to the storage region designated for storing the bitplane data for the even numbered pixels. Bitplane data set $\{a_i^j, a_{i+2}^j, a_{i+4}^j, a_{i+6}^j, a_{i+8}^j, a_{i+10}^j, a_{i+12}^j, a_{i+14}^j\}$ are respectively outputted in parallel by output lines Out[1] through Out[8] with i=2 and j running from 1 to 8 at consecutive time units.

Referring to FIG. 8*b*, another data converter according to another embodiment of the invention is disclosed. As a way of example, the operation of the data converter will be discussed with reference to an operation for transforming an 8×4 pixel data matrix as shown in the left panel of FIG. 8*a* into a desired bitplane data matrix as shown in the right panel of FIG. 8*a*. The pixel data matrix represents the grayscale of 8 pixels using 4 bits. At a time, pixel data $\{a_i^1, a_i^2\ a_i^3\ a_i^4\}$ with i ranging from 1 to 8 represent a grayscale level of pixel i. In contrast, the bitplane data $\{a_j^k, a_{j+2}^k\ a_{j+4}^k\ a_{j+6}^k\}$ with k ranging from 1 to 4 are loaded at consecutive times. In the embodiment of the invention, the bitplane data of the same significance but for the odd numbered pixels and the even numbered pixels are interleaved. For example, the bitplane date $[a_1^i, a_3^i, a_5^i, a_7^i]$ of the bitplane i with i running from 1 to 4 for the odd numbered pixels are in columns 1, 3, 5 and 7. And the bitplane data $[a_2^i, a_4^i, a_6^i, a_8^i]$ of the bitplane i with i running from 1 to 4 for the even numbered pixels are in columns 2, 4, 6 and 8.

As shown in FIG. 8*b*, data converter 120 comprises at least four input lines—In[1], In[2], In[3] and In[4], and at least four output lines—Out[1], Out[2], Out[3] and Out[4]. The data converter further comprises two juxtaposed transpose circuits, each being configured for transposing 2×2 matrices. Specifically, one of the two juxtaposed circuits consists of delay units 160*a* and 160*c* and switch 146*a*. And the other transpose circuit consists of delay units 160*b* and 160*d* and switch 146*b*. These two juxtaposed transpose circuits are concatenated with a similar blocking transposing circuit that has delay units 156*a*, 156*b*, 156*c* and 156*d* and two switches 158*a* and 158*b*. The blocking transposing circuit transposes the matrix in terms of the sub-blocks. In the embodiment of the invention, the delay unit is preferably a register or any other suitable delay circuits. And the switch preferably comprises two juxtaposed multiplexers connected to an activation signal as shown in FIG. 6. Other suitable circuitry having the same functions may also be employed.

Switch 158*a* exchanges data elements between pipelines 2 and 4, and switch 158*b* exchanges data elements between pipelines 1 and 3. Switch 146*a* exchanges data elements between pipelines 1 and 2, and switch 146*b* exchanges data elements between pipelines 3 and 4. The switches 158*a* and 158*b* can be the same as the switch 146*a* or switch 146*b*. However, this is not an absolute requirement. Instead, each of the switches can be different from the other switches. Control signal $C_1$ (controlling the first stage of switches) toggles ON for 4 clock cycles and OFF for 4 clock cycles, while control signal $C_0$ toggles ON for 2 clock cycles and OFF for 2 clock cycles. $C_1$ and $C_0$ must be appropriately delayed with respect to the data and the pipeline delays of the delay stages.

In accordance with the embodiment of the invention, the data converter is associated with a sequence of clock cycles. Specifically, the input lines and the output lines In[1], In[2], In[3] and In[4] are synchronized with a sequence of time-units, each of which may be one clock cycle or a multiple of a clock cycle. Data elements pass through the input lines of the data converter are synchronized with the sequence of time-units thereby.

In an operation, data elements of the pixel data matrix in each row are sequentially delivered into an input line in accordance with the sequence of time units. Data elements of the pixel data matrix in separate rows are delivered into different input lines in parallel. Specifically data elements $\{a_1^i, a_2^i, a_3^i, a_4^i, a_5^i, a_6^i, a_7^i, a_8^i\}$ are sequentially delivered to separate input lines for different i values with i ranging from 1 to 4 such that the data elements in the same input line are sequentially spaced with one time-unit and data elements in the same column are synchronized. Specifically, data element $a_i^1$ is one time-unit in front of data element $a_{i+1}^1$.

The data elements of the third row and the fourth row are then delayed four time-units for each data element by delay units 156*a* and 156*b*. The status of the data elements flowing in the pipelines after the delay units 156*a* and 156*b* are presented in the following:

$$P_1\begin{pmatrix} a_1^1 & a_2^1 & a_3^1 & a_4^1 & a_5^1 & a_6^1 & a_7^1 & a_8^1 \\ a_1^2 & a_2^2 & a_3^2 & a_4^2 & a_5^2 & a_6^2 & a_7^2 & a_8^2 \\ & & & & a_1^3 & a_2^3 & a_3^3 & a_4^3 & a_5^3 & a_6^3 & a_7^3 & a_8^3 \\ & & & & a_1^4 & a_2^4 & a_3^4 & a_4^4 & a_5^4 & a_6^4 & a_7^4 & a_8^4 \end{pmatrix}$$

After being delayed, data elements in the pipelines are exchanged by switches 158*a* and 158*b* in response to the activation signal $C_1$. Specifically, switch 158*a* exchanges data elements between pipelines 2 and 4, and switch 158*b* exchanges data elements between pipelines 1 and 3. Both switches perform the exchange in response to control signal $C_1$, which toggles ON for 4 clock cycles and OFF for 4 clock cycles. The status of data elements in the pipelines are expressed as $p_2$:

$$P_2\begin{pmatrix} a_1^1 & a_2^1 & a_3^1 & a_4^1 & a_1^3 & a_2^3 & a_3^3 & a_4^3 \\ a_1^2 & a_2^2 & a_3^2 & a_4^2 & a_1^4 & a_2^4 & a_3^4 & a_4^4 \\ & & & & a_5^1 & a_6^1 & a_7^1 & a_8^1 & a_5^3 & a_6^3 & a_7^3 & a_8^3 \\ & & & & a_5^2 & a_6^2 & a_7^2 & a_8^2 & a_5^4 & a_6^4 & a_7^4 & a_8^4 \end{pmatrix}$$

Following switches 15*a* and 15*b*, data elements in the first row and the second row are delayed four time units by delay units 156*c* and 156*d*. As a result, at $p_3$, data elements at the pipelines are converted to $p_3$:

$$P_3\begin{pmatrix} a_1^1 & a_2^1 & a_3^1 & a_4^1 & a_1^3 & a_2^3 & a_3^3 & a_4^3 \\ a_1^2 & a_2^2 & a_3^2 & a_4^2 & a_1^4 & a_2^4 & a_3^4 & a_4^4 \\ a_5^1 & a_6^1 & a_7^1 & a_8^1 & a_5^3 & a_6^3 & a_7^3 & a_8^3 \\ a_5^2 & a_6^2 & a_7^2 & a_8^2 & a_5^4 & a_6^4 & a_7^4 & a_8^4 \end{pmatrix}$$

After delay units 156*c* and 156*d*, transpose of the pixel block matrix is complete. Delay units 160*a*, 160*b*, 160*c* and 160*d*, and switched 146*a* and 146*b* then perform transpose to the sub-block matrix of the transposed pixel block matrix. Specifically, the delay units 160*a* and 160*b* respectively delays the data elements in the pipeline 2 and 4 two time units relative to the data elements in the pipelines 1 and 3. The data elements in the pipelines after the delay can be expressed as:

$$\begin{pmatrix} a_1^1 & a_2^1 & a_3^1 & a_4^1 & a_1^3 & a_2^3 & a_3^3 & a_4^3 \\ & & a_1^2 & a_2^2 & a_3^2 & a_4^2 & a_1^4 & a_2^4 & a_3^4 & a_4^4 \\ a_5^1 & a_6^1 & a_7^1 & a_8^1 & a_5^3 & a_6^3 & a_7^3 & a_8^3 \\ & & a_5^2 & a_6^2 & a_7^2 & a_8^2 & a_5^4 & a_6^4 & a_7^4 & a_8^4 \end{pmatrix}$$

The data elements the pass through the switches 146*a* and 146*b*, wherein the data elements are permutated by the switches in response to an activation signal $C_0$, which toggles every two time units. The data elements in the pipelines 1 and 3 are then passed through delay units 160*c* and 160*d*, in which the data elements are delayed two time units relative to the data elements in the pipelines 2 and 4. As a result, the data elements after the delay units 160*c* and 160*d* are expressed as:

$$\begin{pmatrix} a_1^1 & a_2^1 & a_1^2 & a_2^2 & a_1^3 & a_2^3 & a_1^4 & a_2^4 \\ a_3^1 & a_4^1 & a_3^2 & a_4^2 & a_3^3 & a_4^3 & a_3^4 & a_4^4 \\ a_5^1 & a_6^1 & a_5^2 & a_6^2 & a_5^3 & a_6^3 & a_5^4 & a_6^4 \\ a_7^1 & a_8^1 & a_7^2 & a_8^2 & a_7^3 & a_8^3 & a_7^4 & a_8^4 \end{pmatrix}$$

This bitplane data matrix is then outputted via output lines Out[1], Out[2], Out[3], and Out[4]. In an embodiment of the invention, the outputted bitplane data from the data converter are stored in a storage medium, such as the frame buffer in FIG. 1. The storage medium comprises at least two separate regions—one region for storing the bitplane data for odd numbered pixels and another one for storing the bitplane data for even numbered pixels. Given the structure of the bitplane data matrix, wherein the bitplane data for the odd numbered pixels are in odd columns (e.g. columns 1, 3, 5 and 7) and the bitplane data for the even numbered pixels are in even columns (e.g. columns 2, 4, 6 and 8), the bitplane data of the odd numbered pixels and the even numbered pixels are outputted and stored separately.

As discussed above, data converter 120 in FIG. 8 is configured such that a transposing circuit (having delay units 156*a* through 156*d* and switches 158*a* and 158*b*) for transposing data matrices in terms of sub-blocks is disposed in front of the two juxtaposed transpose circuits (having delay units 160*a* through 160*d* and switches 146*a* and 146*b*). As an alternative embodiment, this spatial arrangement can be inversed. For example, the two transpose circuits for transposing sub-blocks can be placed in front of the transpose circuit for transposing the matrix in terms of the sub-blocks. Specifically, the combination of the delay units 160*a*, 160*b*, 160*c* and 160*d* and switches 146*a* and 146*b* can be disposed in front of the combination of the delay units 156*a* through 156*d* and switches 158*a* and 158*b*. In each combination, the relative position and the configuration of the delay units and the switches are the same.

The above discussed method and the apparatus can be extended to a converter for transposing a $2^{n+1}\times2^n$ pixel data matrix, which will be discussed in the following with reference to FIG. 9.

For transposing such pixel data matrices into bitplane matrices, the $2^{n+1}\times2^n$ pixel data matrix is first transformed according to the following transformation scheme. The $2^{n+1}\times2^n$ matrix is transformed into a $2^n\times2^n$ matrix with each data element of the $2^n\times2^n$ matrix represents two adjacent data elements a row of the $2^{n+1}\times2^n$ matrix. For example, the two adjacent data elements $\{a_i^j, a_i^{j+1}\}$ in the $i^{th}$ row and $j^{th}$ and $(j+1)^{th}$ columns of the $2^{n+1}\times2^n$ matrix are represented by one data element $A_i^j$ in the $i^{th}$ row and $j^{th}$ column of the $2^n\times2^{n8}$ matrix. Then $2^n\times2^n$ matrix is then divided into an order of sub-blocks. Specifically, the $2^n\times2^n$ matrix is divided into a pixel block matrix having 2×2 first order sub-blocks. Each first order sub-block has four 2×2 second order sub-blocks, and each second order sub-block has four 2×2 third order blocks. By iterating such transformation method, the $2^n\times2^n$ pixel data matrix is transformed into a pixel block matrix having a plurality of sub-blocks with orders. Each $k^{th}$ order sub-block has 2×2 $(k+1)^{th}$ order sub-blocks, and the $(n-1)^{th}$ order sub-block is a matrix having 2×2 pixel data elements.

In accordance with an embodiment of the invention, the transformed pixel data matrix is first transposed based on the $(n-1)^{th}$ order sub-blocks, each of which has 2×2 pixel data elements following by transposing the pixel data block matrix based on the $(n-2)^{th}$ order sub-blocks. The pixel data matrix is transposed based on the $k^{th}$ order sub-blocks after consecutive transposes of the pixel data matrix based on the $(n-1)^{th}$ order sub-blocks through the $(k+1)^{th}$ order sub-blocks. Then the pixel data block is transposed based on the first order blocks.

Figure 9:
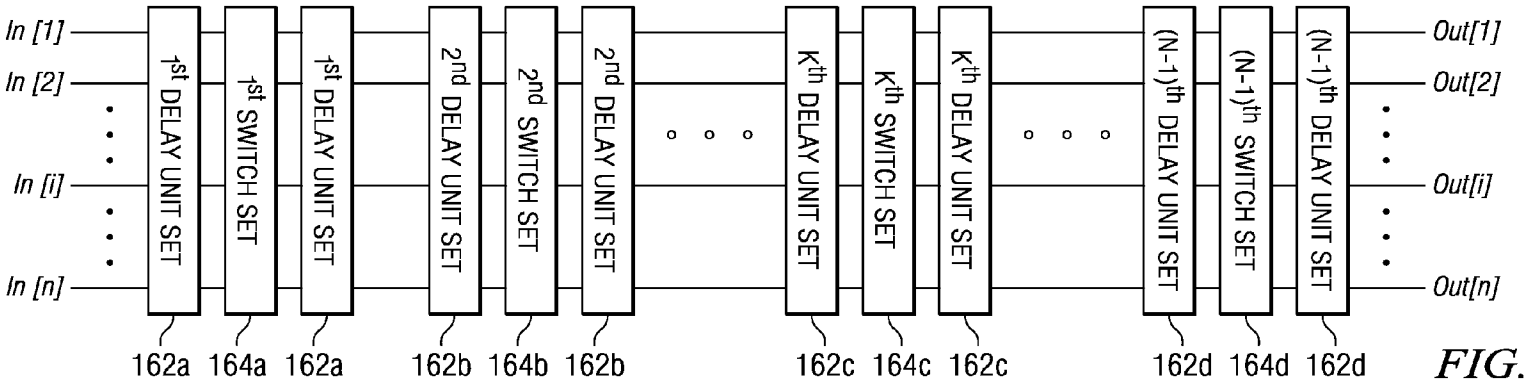
FIG. 9 is a block diagram of a data converter of FIG. 1 according to yet another embodiment of the invention.

Referring to FIG. 9, a data converter according to another embodiment of the invention is disclosed herein. In order to transpose the pixel block matrix into bitplane matrix, the rows of the pixel block matrix are delivered in parallel into the data converter that comprises a plurality of input lines (e.g. In[1] through In[n]), a set of delay-unit sets (e.g. delay unity sets 1 through n−1) and a set of switch sets (e.g. switch sets 1 through n−1). The combination of the $1^{st}$ delay unit set 162*a* and the $1^{st}$ switch set 164*a* performs transpose of the $(n-1)^{th}$ order sub-blocks. The combination of the 2 delay unit set 162*b* and the $2^{nd}$ switch set 164*b* performs transpose of the $(n-2)^{th}$ order sub-blocks that has 2×2 pixel data elements. The combination of the $k^{th}$ delay unit set 162*c* and the $k^{th}$ switch set 164*c* performs transpose on the $(n-k-1)^{th}$ order sub-blocks. And the combination of the $(N-1)^{th}$ delay unit set 162*d* and the $(N-1)^{th}$ switch set 164*d* performs transpose on the $1^{st}$ order sub-blocks. It can also be seen from the figure that, different combinations of the delay unit sets and the switch sets are disposed consecutively. Specifically, the combination of the delay unit set and the switch set with a lower order immediately follows the combination of the delay unit set and the switch set with one order higher. For example, the combination of the $2^{nd}$ order delay unit set and the 2 order switch set is immediately behind the combination of the $1^{st}$ order delay unit set and the $1^{st}$ order switch set. For another example, the combination of the $k^{th}$ order delay unit set and the $k^{th}$ order switch set is immediately behind the combination of the $(k-1)^{th}$ order delay unit set and the $(k-1)^{th}$ order switch set. This arrangement allows for consecutive transposes of sub-matrices with consecutive orders. Moreover, this arrangement guarantees that the transpose of the $k^{th}$ order sub-block matrix is performed after all transposes on the sub-block matrices with orders from n−1 to k.

Each delay unit set comprises one or more delay units (e.g. the delay unit 160*a* or 160*b* in FIG. 4) and delays the passing-by data element two time units. The delay unit preferably comprises a standard flipflop circuit or a shift-register. In the embodiment of the invention, the total number of the delay units in each delay unit set equals $2^{2n-1}$ times the order of the delay unit set, wherein each delay unit delays the passing-by data element two time units. For example, the $k^{th}$ delay unit set has $2^{2k-1}$ delay units, each of which delays the received data elements two time-units. Therefore, the total delayed time-units by the $k^{th}$ delay unit set is $2^{2k-1}$ time units. Each switch set comprises at least two switches, such as switch 136 in FIG. 4. According to the embodiment, each switch set is "sandwiched" by two delay unit sets. For example, the $1^{st}$ switch set is dispose in the middle of two serially disposed $1^{st}$ delay unit sets. The $k^{th}$ switch set is disposed in the middle of two serially disposed $k^{th}$ delay unit sets.

In performing the transpose of the pixel block matrix based on the $(n-1)^{th}$ order sub-blocks each having 2×2 pixel data elements, each $(n-1)^{th}$ order sub-block is transposed by delaying the data elements in the second row of the $(n-1)^{th}$ order sub-block two time-unit relative to the data elements in the first row of the $(n-1)^{th}$ order block; and delaying the data elements in the second column in each row one time-unit relative to the data elements in the first column of the same row of the $(n-1)^{th}$ order sub-block. The delay is performed by the $1^{st}$ delay unit set 162*a* in FIG. 9. The data elements of the delayed $(n-1)^{th}$ order sub-block is then switched at each time-unit by the $1^{st}$ switch set 148 according to a predefined switching rule. The switching rule is listed in table 8.

TABLE 8

| | $1^{st}$ order | $2^{nd}$ order | $K^{th}$ order | $n^{th}$ order |
|---|---|---|---|---|
| Delay time | 2 time unit | 4 time units | $2^k$ time units | $2^n$ time units |
| Switch rule | $R_1 \leftrightarrow R_2$ | $R_1 \leftrightarrow R_3$<br>$R_2 \leftrightarrow R_4$ | $R_1 \leftrightarrow R_{(k/2+1)}$<br>$R_2 \leftrightarrow R_{(k/2+2)}$<br>$R_i \leftrightarrow R_{(k/2+i)}$<br>$R_{k/2} \leftrightarrow R_k$ | $R_1 \leftrightarrow R_{(n/2+1)}$<br>$R_2 \leftrightarrow R_{(n/2+2)}$<br>$R_i \leftrightarrow R_{(n/2+i)}$<br>$R_{n/2} \leftrightarrow R_n$ |

In the table, $R_i \leftrightarrow R_j$ represents an exchange operation by which data element in row i is conditionally exchanged with data element in row j at a given time-unit based on a control signal.

After being switched, the data elements of the first row of the $(n-1)^{th}$ order sub-block are then delayed two time unit by the $1^{st}$ delay unit set.

In performing the transpose of the pixel data matrix based on the first order sub-blocks, the data elements of the pixel data block matrix are delayed by the $(N-1)^{th}$ delay unit set 162*d* according to a sequence of time-units such that: a) data elements of rows 1 through n/2 are not delayed; b) for data elements of rows from n/2+1 through n, data elements at column i and row j is delayed one time-units relative to the data element at column i+1 and row j, and is delayed n time-units relative to the data element at the same column and the first row. The delayed data elements are then switched by the $(N-1)^{th}$ switch set 164*d* according to the switch rule in table 1. Specifically, the switch rule states that: at each time-unit, a) exchanging the data element of row 1 with the data element of row (n/2+1) at the time-unit; and b) exchanging the data element of row i with the data element of row (n/2+i). The switched data elements are then delayed according to the sequence of time-units such that: a) data elements of rows n/2+1 through n are not delayed; b) for data elements of rows from 1 through n/2, data elements at column i and row j is delayed one time-unit relative to the data element at column i+1 and row j, and is delayed n time-units relative to the data element at the same column and the first row.

After consecutively performing the transposes of sub-blocks with consecutive orders starting from n−1 to 1 by the data converter of FIG. 9, the pixel data matrix having $2^{n+1}\times 2^n$ pixel data elements is transposed into the desired bitplane data matrix, in which the bitplane data of the same significance and for the same subgroup of memory cells (e.g. the odd numbered memory cells or the even numbered memory cells) are outputted simultaneously at a time. The bitplane data of consecutive significances for the same pixel are outputted by an output line. The bitplane data for the memory cells of the same subgroup are outputted consecutively. And the bitplane data for the memory cells of different subgroups are outputted separately.

Rather than arranging the delay unit sets and the switch sets in an order as illustrated in FIG. 9, the delay unit sets and the switch sets can be arranged in an inverse order. Specifically, the combination of the delay unit set and the switch set with a lower order immediately in front of the combination of the delay unit set and the switch set with one order higher. For example, the combination of the $2^{nd}$ order delay unit set and the $2^{nd}$ order switch set can be immediately in front of the combination of the $1^{st}$ order delay unit set and the $1^{st}$ order switch set, as long as the other delay unit sets and switch sets obey the same inversed arrangement order. For another example, with the inverted arrangement order, the combination of the $k^{th}$ order delay unit set and the $k^{th}$ order switch set is immediately in front of the combination of the $(k-^1)^{th}$ order delay unit set and the $(k-1)^{th}$ order switch set. And the combination of the $(N-1)^{th}$ delay unit set and the $(N-1)^{th}$ switch set is placed in the front of the data converter—that is, pixel data elements of the pixel data matrix are delivered first into the combination of the $(N-1)^{th}$ delay unit set and the $(N-1)^{th}$ switch set.

Rather than arranging the delay units sets and the switch sets in the ascending order (as shown in FIG. 9) or the descending order as discussed above, the delay units and the switch sets can be arranged randomly. Specifically, combinations of the delay unit sets and the switch set of the same order can be disposed randomly along the input lines. For example, the combination of the $m^{th}$ order delay unit sets and the $m^{th}$ order switch set can be disposed between a combination of the $i^{th}$ order delay unit sets and the $i^{th}$ order switch set and a combination of the $j^{th}$ order delay unit sets and the $j^{th}$ order switch set, wherein $i\neq m\pm 1$ and $j\neq m\pm 1$. Accordingly, the pixel data matrix is transposed by random orders.

In addition to a pixel data matrix having $2^{n+1}\times 2^n$ pixel data elements, the method and the data converter as discussed with reference to FIG. 9 can be also be applied in transposing pixel data matrices having $2^{n+1}\times m$ pixel data elements with m being an integer not equal to $2^{n+1}$ into a bitplane data matrix.

For a pixel data matrix having $2^{n+1}\times m$ pixel data elements with m being an integer smaller than $2^{n+1}$, a number of rows of "fake" data elements can be inserted into the pixel data matrix such that the pixel data matrix after insertion is a $2^{n+1}\times 2^n$ pixel data matrix. Each row of "fake" data elements consists of $2^n$ "fake" data elements, and $(2^n-m)$ such rows are inserted into the pixel data matrix. These "fake" data rows can be attached inserted before the first row of the pixel data matrix, or appended after the last row of the pixel data matrix, or inserted between the rows of the pixel data matrix, as long as the insert positions are memorized.

After performing the transpose method discussed above, the inserted "fake" data elements are removed from the transposed pixel data matrix having "fake" data elements. As a way of example, $(2^n-m)$ rows of "fake" data elements are appended after the $m^{th}$ row of the pixel data matrix. After transpose, the "fake" data elements are located at positions from the $(2^{n+1}-m)^{th}$ column to the $(2^{n+1})^{th}$ column in each row. Therefore, by truncating the columns from the $(2^{n+1}-m)^{th}$ column to the $(2^{n+1})^{th}$ column, the bitplane matrix is obtained. These 'fake' data elements may be implemented by hardwiring some inputs of the transposer to 0 or 1; this may allow some of the delay elements or parts of the switch logic to be optimized away or reduced.

The methods and the apparatus as discussed with reference to FIG. 5 through FIG. 9 can be characterized using a plurality of parameters, such as the longest path delay, the total number of flipflops, the total number of shift-registers, the total number of multiplexers and the control signal fanout. The longest path delay is defined as the length of the longest combinational logic path between delay elements or I/Os, in terms of 2-input multiplexers. The control signal fanout is defined as the total number of loads driven by any control signal to the switches/multiplexers (e.g. the multiplexers 137*a* and 137*b* in FIG. 6). Values of these parameters are listed in table 9 when the method and the apparatus as discussed above are employed in transposing a matrix having N columns, where N is a power of 2. In certain implementation technologies, the cost (in terms of circuit area) of a multiple-cycle delay element (i.e. a shift register) may be significantly less than the cost of the corresponding number of individual flipflops. For example, certain FPGA architectures allow implementation of a 16-element shift register in a single logic block. For this reason the table also tallies the total number of shift registers (of arbitrary length) in the design which may be more representative of the area cost of the design in such technologies.

TABLE 9

| Longest path delay | Number of Flipflops | Number of shift-registers | Number of multiplexers | Control fanout |
|---|---|---|---|---|
| $\log_2 N$ | $2(N^2 - N)$ | $\{(3/4)N\log_2 N + (1/4)\log_2 N\}$ | $N \log_2 N$ | N |

In practice, the pixel data matrix can be a rectangular matrix having m columns and n rows where n may not be a power of 2. A method and an apparatus for transposing such pixel data matrices will be discussed in the following with reference to FIG. 10. Obviously, such method and apparatus are also applicable for transposing $2^{n+1}\times 2^n$ pixel data matrices and $2^{n+1}\times m$ pixel data matrices.

Figure 10:
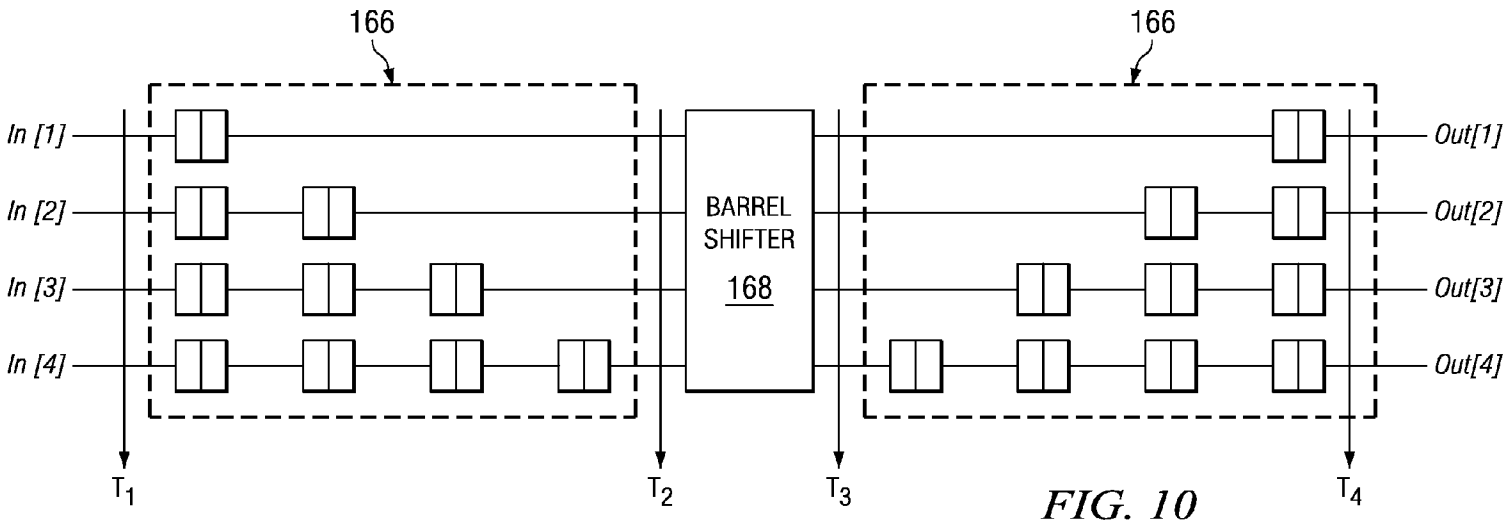
FIG. 10 is a block diagram of a data converter of FIG. 1 according to yet another embodiment of the invention.

Referring to FIG. 10, the data converter comprises delay unit set 166 and shifter 168, which is preferably a barrel shifter. Under control of a set of control signals, the barrel shifter provides on its output a circularly rotated version of its inputs, where the number of positions the data is rotated is determined by the control inputs. An exemplary barrel shifter is illustrated in FIG. 5*b*. The barrel shifter comprises N inputs, represented by In[1], In[2], through In[N], and N outputs, represented by Out[1] through Out[N]. In response to a control signal "Q", the N input data are circularly rotated with Q positions as shown in the figure, wherein Q is an integer less than N.

Referring back to FIG. 10, for simplicity and demonstration purposes only, only four input lines and four out lines are illustrated in the barrel shifter in the figure.

According to the embodiment of the invention, delay unit set 166 comprises a set of delay units, such as the delay unit 160*a* or 160*b* in FIG. 8*b*. Each delay unit delays the passing-by data elements two time units. In the embodiment of the invention, the delay unit comprises a flipflop circuit or a shift register. The delay units are deployed along the input lines of the data converter such that k number of delay units are disposed along the $k^{th}$ input line in front of shifter 144, and another k number of delay units are disposed along the $k^{th}$ input line after shifter 144, wherein each delay unit delays an date element two time units. For example, one delay unit is disposed along the first input line In[1] in front of shift 168 and another delay unit is disposed along the first input line after shifter 168. For another example, three delay units are disposed along the third input line In[3] in front of shift 168 and another three delay units are disposed along the third input line after shifter 168.

For simplicity and demonstration purposes, the transposing method using the data converter in FIG. 10 will be discussed with reference to transposing a pixel data matrix having eight columns and four rows as presented in FIG. 8*a*.

In the transform operation, the data converter is associated with a sequence of clock cycles. Specifically, the input lines are synchronized with a sequence of time-units, each being a multiple of a clock cycle. As a result, data elements flowing through the input lines are synchronized with the sequence of time units.

The four rows are separately connected to the four input lines—In[1], In[2], In[3] and In[4] such that pixel data elements of separate rows are delivered into the input lines of the data converter in parallel. The pixel data elements in each row are delivered sequentially into an input line such that the adjacent pixel data elements in a row have one time-unit difference in time relative to each other. Specifically, data element $a_i^j$ of row i is delayed one time-unit relative to data element $a_i^{j+1}$ of the same row. Data elements of the same column are synchronized with the same time-unit. The data elements then pass through delay unit set 166 located in front of shifter 168 and are delayed thereby. Consequently, a pixel data at column i and row j is delayed 2(j−1) time-units relative to the data at column i and the first row, and one time-unit relative to the data element at column i+1 and row j. The status of the data elements at position $T_2$ is presented in the following:

$$T_2\begin{pmatrix} a_1^1 & a_2^1 & a_3^1 & a_4^1 & a_5^1 & a_6^1 & a_7^1 & a_8^1 & & & & \\ & & a_1^2 & a_2^2 & a_3^2 & a_4^2 & a_5^2 & a_6^2 & a_7^2 & a_8^2 & & \\ & & & & a_1^3 & a_2^3 & a_3^3 & a_4^3 & a_5^3 & a_6^3 & a_7^3 & a_8^3 \\ & & & & & & a_1^4 & a_2^4 & a_3^4 & a_4^4 & a_5^4 & a_6^4 & a_7^4 & a_8^4 \end{pmatrix}$$

The delayed data elements are then shifted by shifter 168 according to the sequence of time-units and based on a shifting rule. In the embodiment of the invention, the shifting rule states that: for a matrix having m columns and n rows, the data element of row j at the $k^{th}$ time-unit of the time-unit sequence is shifted to row ((n+j)−floor((k−1)/2))mod n)+1 at the same time-unit; wherein k runs from 1 to (m+n) time-units. The data elements after the barrel shifter at $T_3$ is illustrated in the following:

$$T_3\begin{pmatrix} a_7^1 & a_7^2 & a_7^3 & a_7^4 & a_8^1 & a_8^2 & a_8^3 & a_8^4 & & & & \\ & & a_5^1 & a_5^2 & a_5^3 & a_5^4 & a_6^1 & a_6^2 & a_6^3 & a_6^4 & & \\ & & & & a_3^1 & a_3^2 & a_3^3 & a_3^4 & a_4^1 & a_4^2 & a_4^3 & a_4^4 \\ & & & & & & a_1^1 & a_1^2 & a_1^3 & a_1^4 & a_2^1 & a_2^2 & a_2^3 & a_2^4 \end{pmatrix}$$

The shifted data elements are delayed by delay unit set 166 located behind shift 168. Similar to the delay process in the delay unit set in front of the shifter, the shifted data elements are shifted according to the sequence of time-units such that a data element of row j at time-unit p is delayed 2(j−1) time-units relative to the data element of row 1 at time-unit p. After this delay, the m×n pixel data matrix is transformed and the bitplane data matrix at position $T_4$ is obtained, as shown in the following.

$$T_4\begin{pmatrix} a_7^1 & a_7^2 & a_7^3 & a_7^4 & a_8^1 & a_8^2 & a_8^3 & a_8^4 \\ a_5^1 & a_5^2 & a_5^3 & a_5^4 & a_6^1 & a_6^2 & a_6^3 & a_6^4 \\ a_3^1 & a_3^2 & a_3^3 & a_3^4 & a_4^1 & a_4^2 & a_4^3 & a_4^4 \\ a_1^1 & a_1^2 & a_1^3 & a_1^4 & a_2^1 & a_2^2 & a_2^3 & a_2^4 \end{pmatrix}$$

The bitplane data of the bitplane data matrix can be loaded into the memory cells for actuating the mirror plates of the micromirror array within the spatial light modulator or stored in the frame buffer.

The methods as discussed with reference to FIG. 9 and FIG. 10 can be characterized using a plurality of parameters, such as the longest path delay, the total number of flipflops, the total number of shift-registers, the total number of multiplexers and the control signal fanout. Values of these parameters are listed in table 3 when the method and the apparatus as discussed above are employed in transposing a matrix having N columns.

TABLE 10

| Longest path delay | Number of Flipflops | Number of shift-registers | Number of multiplexers | Control fanout |
|---|---|---|---|---|
| ceil($\log_2$ N) | $2(N^2 - N)$ | $(2N - 2)$ | N $\log_2$ N | N |

Other than implementing the embodiments of the present invention in data converter 120 in FIG. 1, the embodiments of the present invention may also be implemented in a microprocessor-based programmable unit, and the like, using instructions, such as program modules, that are executed by a processor. Generally, program modules include routines, objects, components, data structures and the like that perform particular tasks or implement particular abstract data types. The term "program" includes one or more program modules. When the embodiments of the present invention are implemented in such a unit, it is preferred that the unit communicates with the controller, takes corresponding actions to signals, such as actuation signals from the controller.

It will be appreciated by those skilled in the art that a new and useful method and apparatus for transposing pixel data matrices into bitplane data matrices for use in display systems having micromirror arrays have been described herein. In view of many possible embodiments to which the principles of this invention may be applied, however, it should be recognized that the embodiments described herein with respect to the drawing figures are meant to be illustrative only and should not be taken as limiting the scope of invention. For example, those of skill in the art will recognize that the illustrated embodiments can be modified in arrangement and detail without departing from the spirit of the invention. Therefore, the invention as described herein contemplates all such embodiments as may come within the scope of the following claims and equivalents thereof.

I claim:

1. A system comprising:

a data processing unit receiving a series of pixel data streams, each pixel data stream comprising multiple data bits representing an image pixel, the data processing unit receiving the series of pixel data streams and outputting a series of bit plane data streams, each bit plane data stream representing a data bit of a common significance from a plurality of image pixels;

a memory cell array receiving the bit plane data, wherein a row of said array comprises a first and second subset, each subset having one or more memory cells;

a first wordline and a second wordline, wherein the first wordline is connected to the first subset memory cells, and the second wordline is connected to the second subset memory cells;

a first set of data to be loaded into the first subset of memory cells that are activated through the first wordline, wherein the first set of data is consecutively stored in a first region of a storage medium; and a second set of data to be loaded into the second subset of memory cells that are activated through the second wordline, wherein the second set of data is consecutively stored in a second region of the storage medium.

2. The system of claim 1, wherein the memory cell array is a portion of a spatial light modulator that comprises an array of pixel elements, each of which corresponds to a pixel of an image; and wherein each memory cell corresponds to at least one pixel element of the spatial light modulator.

3. The system of claim 2, wherein each pixel element of the spatial light modulator further comprises a movable mirror plate that is associated with a memory cell of the memory cell array, such that a state of the mirror plate is determined by the data stored in said memory cell.

4. The system of claim 2, wherein each memory cell is associated with a plurality of pixel elements of the spatial light modulator; and wherein the memory cell stores a data that determines a state of one of the plurality of pixel elements.

5. The system of claim 1, further comprising:

a plurality of bit lines connected to the storage medium and the memory cells such that the data stored in the storage medium are delivered into the memory cells via the bit lines.

6. The system of claim 1, wherein the first set of data and the second set of data are bit plane data.

7. The system of claim 1, wherein the first wordline connects the even numbered memory cells of the row, and the second wordline connects the odd numbered memory cells of the row.

8. The system of claim 1, wherein the first set of data is to be loaded into the even numbered memory cells of the row and the second set of data is to be loaded into the odd numbered memory cells of the row.

9. The system of claim 1, wherein the memory cells are charge-pump-memory cells, each of which further comprises:

a transistor having a source, a gate, and a drain;

a storage capacitor having a first plate and a second plate; and wherein the source of said transistor is connected to a bitline, the gate of said transistor is connected to a wordline, and wherein the drain of the transistor is connected to the first plate of said storage capacitor forming a storage node, and wherein the second plate of said storage capacitor is connected to a pump signal.

10. The system of claim 1, wherein the memory cells are DRAM cells.

11. The system of claim 1, wherein the converter is associated with a sequence of clock cycles.

12. The system of claim 11, wherein the converter further comprises:

a plurality of inputs, each input receiving a sequence of data signals;

a set of delay units connected to the input lines, each delay unit delaying a received data signal a predefined number of clock cycles; and a switch connected to the delay units and the input lines for permuting received data between the input lines based on a predefined permutation rule.

13. The system of claim 12, wherein the delay unit comprises one or more flip-flops.

14. The system of claim 12, wherein the delay unit is a shift-register.

15. The system of claim 12, wherein the switch comprises one or more multiplexers.

16. The system of claim 1, further comprising: an image source.

17. The system of claim 16, wherein the image source outputs an analog image signal.

18. The system of claim 16, wherein the image source is connected to the data processing unit such that the data processing unit receives the analog image signal and transforms the analog image signal into a bit plane data.

19. The system of claim 16, wherein the image source outputs pixel image data complying with a pixel data format.

20. A method for writing a memory cell array, wherein a row of the memory cell array comprises a first and second subset of memory cells, each subset having one or more memory cells, the method comprising:

receiving a series of pixel data streams, each pixel data stream comprising multiple data bits representing an image pixel;

transposing the series of pixel data streams into a series of bit plane data streams, each bit plane data stream representing a data bit of a common significance from a plurality of image pixels;

connecting the memory cells of the first subset to a first wordline, and the memory cells of the second subset to a second wordline;

storing a first and second set of data comprising at least a portion of a transposed bit plane such that the data of the first set are stored consecutively in a first region and the data of the second set are consecutively stored in a second region separate from the first region;

activating the memory cells of the first subset through the first wordline; and loading the first set of data into the activated first subset of memory cells.

21. The method of claim 20, further comprising:

activating the memory cells of the second subset through the second wordline; and loading the second set of data into the activated second subset of memory cells.

22. The method of claim 20, wherein the step of storing the first and second set of data further comprises:

storing a first set of bit plane data in the first region, and a second set of bit plane data other than the first set of bit plane data in the second region.

23. The method of claim 20, further comprising:

connecting each memory cell to an electrode such that an electrical potential of the electrode is determined by the data stored in said memory cell.

24. The method of claim 23, further comprising:

disposing the electrode proximate to a mirror plate of a micromirror such that an electrostatic field is established between the electrode and the mirror plate, and the mirror plate rotates in response to the established electrostatic field.

25. The method of claim 20, wherein the step of transposing the pixel data matrix further comprises:

delivering the pixel data into a plurality of input lines that are associated with the sequence of clock cycles;

delaying the pixel data with reference to the sequence of clock cycles according to a predefined delay scheme; and permuting the pixel data between the input lines based on a predefined permutation scheme.

26. The method of claim 25, wherein the step of delaying is performed by one or more standard flipflop circuits.

27. The method of claim 25, wherein the step of delaying is performed by a shift-register.

28. The method of claim 25, wherein the step of switching is performed in response to one or more switch signals.

29. The method of claim 28, wherein the switch is performed by a multiplexer having an input for the switch signal.

30. The method of claim 20, further comprising:

providing the memory cell array as a portion of a spatial light modulator that comprises an array of pixel elements, each of which corresponds to a pixel of an image; and wherein each memory cell corresponds to at least one pixel element of the spatial light modulator.

31. The method of claim 30, wherein each pixel element of the spatial light modulator further comprises a movable mirror plate that is associated with a memory cell of the memory cell array, such that a state of the mirror plate is determined by the data stored in said memory cell.

32. The system of claim 30, wherein each memory cell is associated with a plurality of pixel elements of the spatial light modulator; and wherein the memory cell stores a data that determines a state of one of the plurality of pixel elements.

* * * * *